US010364409B2

(12) United States Patent
Walters et al.

(10) Patent No.: US 10,364,409 B2
(45) **Date of Patent: *Jul. 30, 2019**

(54) SOLIDIFICATION MATRIX COMPRISING A CARBOXYLIC ACID TERPOLYMER

(71) Applicant: Ecolab USA Inc., Saint Paul, MN (US)

(72) Inventors: Kerrie Walters, Minneapolis, MN (US); Carter M. Silvernail, Burnsville, MN (US); Juergen Detering, Limburgerhof (DE); Arend Jouke Kingma, Weisenheim am Sand (DE); James S. Dailey, Grosse Ile, MI (US)

(73) Assignee: Ecolab USA Inc., Saint Paul, MN (US)

( * ) Notice: Subject to any disclaimer, the term of this patent is extended or adjusted under 35 U.S.C. 154(b) by 198 days.

This patent is subject to a terminal disclaimer.

(21) Appl. No.: 15/272,848

(22) Filed: Sep. 22, 2016

(65) Prior Publication Data

US 2017/0009190 A1 Jan. 12, 2017

Related U.S. Application Data

(63) Continuation of application No. 14/049,989, filed on Oct. 9, 2013, now Pat. No. 9,487,738.

(51) Int. Cl.

| | |
|---|---|
| ***C11D 17/00*** | (2006.01) |
| ***C11D 3/10*** | (2006.01) |
| ***C11D 3/37*** | (2006.01) |
| ***C11D 3/00*** | (2006.01) |

(52) U.S. Cl.

CPC ..... *C11D 17/0047* (2013.01); *C11D 3/0036* (2013.01); *C11D 3/10* (2013.01); *C11D 3/378* (2013.01); *C11D 17/0052* (2013.01)

(58) Field of Classification Search

None

See application file for complete search history.

(56) References Cited

U.S. PATENT DOCUMENTS

| | | | |
|---|---|---|---|
| 3,672,820 | A | 6/1972 | Toth et al. |
| 3,720,621 | A | 3/1973 | Smeets |
| 4,711,725 | A | 12/1987 | Amick et al. |
| 4,752,409 | A | 6/1988 | Drapier et al. |
| 5,039,447 | A | 8/1991 | Reuben |
| 5,082,578 | A | 1/1992 | Langer et al. |
| 5,229,027 | A | 7/1993 | Ahmed |
| 5,292,447 | A | 3/1994 | Venturello et al. |
| 5,294,362 | A | 3/1994 | Venturello et al. |
| 5,413,727 | A | 5/1995 | Drapier et al. |
| 5,413,731 | A | 5/1995 | Adler et al. |
| 5,422,028 | A | 6/1995 | Oakes et al. |
| 5,691,292 | A | 11/1997 | Marshall et al. |
| 6,114,292 | A | 9/2000 | Hoshiko et al. |
| 6,153,913 | A | 11/2000 | Hsu et al. |
| 6,207,780 | B1 | 3/2001 | Stockhausen et al. |
| 6,462,006 | B1 | 10/2002 | Sorg et al. |
| 6,622,736 | B1 | 9/2003 | Hahn |
| 7,192,911 | B2 | 3/2007 | Sunder et al. |
| 8,093,196 | B2 | 1/2012 | Seebeck et al. |
| 9,487,738 | B2 * | 11/2016 | Walters ..... C11D 3/10 |
| 2004/0167048 | A1 | 8/2004 | Sunder et al. |
| 2005/0075258 | A1 | 4/2005 | Kessler et al. |
| 2005/0113280 | A1 | 5/2005 | Reddy et al. |
| 2005/0202994 | A1 | 9/2005 | Baum et al. |
| 2006/0015509 | A1 | 1/2006 | Naitou |
| 2007/0082831 | A1 | 4/2007 | Guzmann et al. |
| 2007/0129516 | A1 | 6/2007 | Detering et al. |
| 2007/0149436 | A1 | 6/2007 | Boeckh et al. |
| 2007/0238637 | A1 | 10/2007 | Michl et al. |
| 2008/0188391 | A1 | 8/2008 | Seebeck et al. |
| 2010/0004154 | A1 | 1/2010 | Detering et al. |
| 2010/0065090 | A1 | 3/2010 | Tropsch |
| 2010/0160203 | A1 | 6/2010 | Seebeck et al. |
| 2010/0227787 | A1 | 9/2010 | Seebeck et al. |
| 2010/0249010 | A1 | 9/2010 | Seebeck et al. |

(Continued)

FOREIGN PATENT DOCUMENTS

| | | | |
|---|---|---|---|
| CA | 2311173 | A1 | 12/2000 |
| CA | 2312154 | A1 | 1/2001 |
| CA | 2817174 | A1 | 5/2012 |
| CN | 1239503 | A | 12/1999 |
| DE | 2029598 | A1 | 12/1970 |
| DE | 2264230 | A1 | 7/1974 |
| DE | 3643334 | A1 | 7/1987 |
| DE | 3729381 | A1 | 3/1988 |
| DE | 3743739 | A1 | 7/1989 |
| DE | 4417919 | A1 | 11/1995 |
| DE | 19516957 | A1 | 11/1996 |
| DE | 19819187 | A1 | 11/1999 |
| DE | 19822939 | A1 | 11/1999 |
| DE | 19926378 | A1 | 12/2000 |
| DE | 20019913 | U1 | 5/2001 |

(Continued)

OTHER PUBLICATIONS

International Search Authority, "The International Search Report and The Written Opinion", issued in connection with International Application No. PCT/US2014/059859, 14 pages, dated Feb. 27, 2015.

(Continued)

*Primary Examiner* — Lorna M Douyon

(74) *Attorney, Agent, or Firm* — McKee, Voorhees & Sease, PLC

(57) ABSTRACT

Stability enhancement agents for use in a solidification matrices and solid detergent compositions are described. Stability enhancement is provided by a hydratable salt, water and a carboxylic acid terpolymer forming a dimensionally stable solid compositions. Preferred carboxylic acid terpolymers include from about 40 to 90% by weight of a carboxylic acid monomer, anhydride or salt thereof, from about 4 to 40% by weight of a monomer comprising sulfo groups, and from about 4 to 40% by weight of a nonionic monomer set forth in formula (I). The stability enhancement composition for use in solid detergent compositions are preferably biodegradable and may be substantially free of phosphate and/or NTA-free and provide beneficial hard water scale control.

8 Claims, No Drawings

(56) References Cited

U.S. PATENT DOCUMENTS

| | | | |
|---|---|---|---|
| 2011/0124546 | A1 | 5/2011 | Tjelta et al. |
| 2011/0124547 | A1 | 5/2011 | Tjelta et al. |
| 2011/0245132 | A1 | 10/2011 | Dupont et al. |
| 2012/0010117 | A1 | 1/2012 | Seebeck et al. |
| 2012/0122751 | A1 | 5/2012 | Stenger et al. |
| 2012/0129749 | A1 | 5/2012 | Detering et al. |
| 2012/0129750 | A1 | 5/2012 | Detering et al. |
| 2012/0196784 | A1 | 8/2012 | Seebeck et al. |
| 2013/0037491 | A1 | 2/2013 | Detering et al. |
| 2013/0102518 | A1 | 4/2013 | Miralles et al. |
| 2013/0261042 | A1 | 10/2013 | Stenger et al. |

FOREIGN PATENT DOCUMENTS

| | | | |
|---|---|---|---|
| DE | 10133136 | A1 | 1/2003 |
| DE | 10153553 | A1 | 6/2003 |
| DE | 10225794 | A1 | 12/2003 |
| EP | 0070587 | A1 | 1/1983 |
| EP | 0070587 | B1 | 1/1983 |
| EP | 0383482 | A2 | 8/1990 |
| EP | 0383482 | A3 | 8/1990 |
| EP | 0383482 | B1 | 8/1990 |
| EP | 0387997 | A2 | 9/1990 |
| EP | 0387997 | A3 | 9/1990 |
| EP | 0387997 | B1 | 9/1990 |
| EP | 0439878 | A1 | 8/1991 |
| EP | 0446761 | A1 | 9/1991 |
| EP | 0518721 | A1 | 12/1992 |
| EP | 0518721 | B1 | 12/1992 |
| EP | 0530635 | A2 | 3/1993 |
| EP | 0530635 | A3 | 3/1993 |
| EP | 0530635 | B1 | 3/1993 |
| EP | 0611206 | A2 | 8/1994 |
| EP | 0611206 | A3 | 8/1994 |
| EP | 0712810 | A2 | 5/1996 |
| EP | 0712810 | A3 | 5/1996 |
| EP | 0712810 | B1 | 5/1996 |
| EP | 0727448 | B1 | 8/1996 |
| EP | 0778340 | A2 | 6/1997 |
| EP | 0798320 | A2 | 10/1997 |
| EP | 0851022 | A2 | 7/1998 |
| EP | 0851022 | B1 | 7/1998 |
| EP | 0851023 | A2 | 7/1998 |
| EP | 1213344 | A3 | 6/2002 |
| EP | 1354936 | A1 | 10/2003 |
| JP | 2010111792 | A | 5/2010 |
| WO | 9321299 | A1 | 10/1993 |
| WO | 9612783 | A1 | 5/1996 |
| WO | 9816612 | A1 | 4/1998 |
| WO | 9816613 | A1 | 4/1998 |
| WO | 9957237 | A1 | 11/1999 |
| WO | 0039259 | A1 | 7/2000 |
| WO | 0056851 | A1 | 9/2000 |
| WO | 0100781 | A1 | 1/2001 |
| WO | 0172941 | A1 | 10/2001 |
| WO | 0216205 | A1 | 2/2002 |
| WO | 0220708 | A1 | 3/2002 |
| WO | 0242408 | A2 | 5/2002 |
| WO | 02074891 | A3 | 9/2002 |
| WO | 02074892 | A1 | 9/2002 |
| WO | 03006593 | A2 | 1/2003 |
| WO | 03006594 | A1 | 1/2003 |
| WO | 2005008527 | A1 | 1/2005 |
| WO | 2005042684 | A1 | 5/2005 |
| WO | 2008132131 | A1 | 11/2008 |
| WO | 2010024468 | A1 | 3/2010 |
| WO | 2010086821 | A2 | 8/2010 |
| WO | 2011003961 | A2 | 1/2011 |

OTHER PUBLICATIONS

International Search Authority, "The International Search Report and the Written Opinion", issued in connection with International Application No. PCT/US2014/059878, 12 pages, dated Jan. 15, 2015.

* cited by examiner

SOLIDIFICATION MATRIX COMPRISING A CARBOXYLIC ACID TERPOLYMER

CROSS-REFERENCE TO RELATED APPLICATIONS

This application is a continuation of nonprovisional application U.S. Ser. No. 14/049,989, filed Oct. 9, 2013, now U.S. Pat. No. 9,487,738, which is herein incorporated by reference in its entirety.

FIELD OF THE INVENTION

The present invention relates generally to the field of solidification and solidification matrices. In particular, the invention relates to the development of dimensionally stable, solid detergent compositions containing an alkali metal carbonate or other hydratable salt, furthermore water and carboxylic acid terpolymer binding agent(s).

BACKGROUND OF THE INVENTION

The use of solidification technology and solid block detergents in institutional and industrial operations was pioneered in the SOLID POWER® brand technology claimed in Femholz et al., U.S. Reissue Pat. Nos. 32,762 and 32,818. Additionally, sodium carbonate hydrate cast solid products using substantially hydrated sodium carbonate materials was disclosed in Heile et al., U.S. Pat. Nos. 4,595,520 and 4,680,134.

In more recent years, attention has been directed to producing highly effective detergent materials from less caustic materials such as soda ash, also known as sodium carbonate. Early work in developing the sodium carbonate based detergents found that sodium carbonate hydrate-based materials often swelled, cracked or crumbled after solidification (i.e., were dimensionally unstable as a result of kinetic and/or thermodynamic instability). Such swelling can interfere with packaging, dispensing, and use. The dimensional instability of the solid materials relates to the unstable nature of various hydrate forms prepared in manufacturing the sodium carbonate solid materials. Early products made with hydrated sodium carbonate typically comprised of anhydrous, a one mole hydrate, a seven mole hydrate, a ten mole hydrate or more mixtures thereof.

However, after the product had been manufactured and stored at ambient temperatures, the hydration state of the initial product was found to shift between hydrate forms, e.g., one, seven, and ten mole hydrates, resulting in dimensional instability of the product. In these conventional solid form compositions, changes in water content and temperature lead to structural and dimensional change, which may lead to a failure of the solid form, resulting in problems such as the inability of the solid form to fit into dispensers for use.

It was found, disclosed, and claimed in U.S. Pat. Nos. 6,258,765, 6,156,715, 6,150,324, and 6,177,392, that a solid block functional material could be made using a binding agent that includes a carbonate salt, an organic acetate, such as an aminocarboxylate, or phosphonate component and water.

Accordingly, it is an objective of the claimed invention to provide solid detergent compositions that exhibit exceptional dimensional stability, including kinetic and/or thermodynamic stability.

BRIEF SUMMARY OF THE INVENTION

A stability enhancement agent for solid detergent compositions is disclosed. The stability enhancement for solid detergent compositions becomes detectable through the enhanced dimensional stability that may be brought about by controlling water movement within the solid composition or forming favorable interactions with other components, including detergent components, in the composition to provide dimensional stability.

In an embodiment, the present invention provides a solid detergent composition comprising: a carboxylic acid terpolymer; a hydratable salt, such as an alkali metal carbonate; and water.

In another embodiment, the present invention provides a solid detergent composition comprising an carboxylic acid terpolymer; a hydratable salt, such as an alkali metal carbonate; surfactant and water, wherein the solid detergent composition is dimensionally stable and has a growth exponent of less than 3% if heated at a temperature of 122° F. and preferably kept at 122° F. for some time, such as at least 30 minutes, or at least one hour, or even up to two weeks.

In a further embodiment, the present invention provides a solid detergent composition comprising: between about 0.1 wt-% and about 20 wt-% a carboxylic acid terpolymer, hereinafter also referred to as terpolymer (A), said terpolymer (A) comprising in copolymerized form from about 30 to 90% by weight of at least one monoethylenically unsaturated $C_3$-$C_8$-carboxylic acid, or an anhydride or salt thereof, from about 3 to 60% by weight of at least one monomer comprising a sulfo group, and from about 3 to 20%, preferably up to 20% by weight of at least one nonionic monomer of the formula I $$H_2C{=}C(R^1)(CH_2)_xO[R^2{-}O]_y{-}R^3 \quad (I)$$

in which $R^1$ is hydrogen or methyl, $R^2$ are identical or different, linear or branched $C_2$-$C_6$-alkylene wherein $R^2$-0 may be arranged in blocks or randomly, and $R^3$ is hydrogen or a straight-chain or branched $C_1$-$C_4$-alkyl, x is 0, 1 or 2 and y is a number from 3 to 50; between about 0.1 wt-% and about 50 wt-% water; between about 40 wt-% and about 95 wt-% an alkali metal carbonate; and between about 0.5 wt-% and about 10 wt-% surfactant; and wherein the solid detergent composition is dimensionally stable and has a growth exponent of less than 3% if heated at a temperature of 122° F. and preferably kept at 122° F. for some time, such as at least 30 minutes, or at least one hour, or even up to two weeks.

In another embodiment, the present invention provides a method of forming a solid detergent composition comprising: combining an alkali metal carbonate, water and terpolymer (A).

In a further embodiment, the present invention provides a method of forming a solid detergent composition comprising: combining an alkali metal carbonate (or other hydratable salt), water and at least one functional component to form a powder pre-mix; and mixing the powder pre-mix with a liquid pre-mix, the liquid pre-mix comprising a terpolymer (A).

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION OF THE PREFERRED EMBODIMENT

The embodiments of this invention are not limited to particular solid detergent compositions as they may vary as understood by skilled artisans. It is further to be understood that all terminology used herein is for the purpose of describing particular embodiments only, and is not intended to be limiting in any manner or scope. For example, as used in this specification and the appended claims, the singular forms "a," "an" and "the" can include plural referents unless the content clearly indicates otherwise. Further, all units, prefixes, and symbols may be denoted in its SI accepted form. Numeric ranges recited within the specification are inclusive of the numbers defining the range and include each integer within the defined range.

So that the present invention may be more readily understood, certain terms are first defined. Unless defined otherwise, all technical and scientific terms used herein have the same meaning as commonly understood by one of ordinary skill in the art to which embodiments of the invention pertain. Many methods and materials similar, modified, or equivalent to those described herein can be used in the practice of the embodiments of the present invention without undue experimentation, the preferred materials and methods are described herein. In describing and claiming the embodiments of the present invention, the following terminology will be used in accordance with the definitions set out below.

The term "about," as used herein, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

The term "cleaning," as used herein, refers to performing or aiding in any soil removal, bleaching, microbial population reduction, or combination thereof.

The terms "dimensional stability" and "dimensionally stable" as used herein, refer to a solid product having a growth exponent of less than about 3%. Although not intending to be limited according to a particular theory, the carboxylic acid terpolymers are believed to control the rate of water migration for the hydration of sodium carbonate. The carboxylic acid terpolymers may stabilize the solid composition by acting as a donor and/or acceptor of free water and controlling the rate of solidification.

As used herein, "terpolymer" refers to a polymer formed from three or more chemically different monomers.

The term "weight percent," "wt-%," "percent by weight," "% by weight," and variations thereof, as used herein, refer to the concentration of a substance as the weight of that substance divided by the total weight of the composition and multiplied by 100. It is understood that, as used here, "percent," "%," and the like are intended to be synonymous with "weight percent," "wt-%," etc.

The methods and compositions of the present invention may comprise, consist essentially of, or consist of the components and ingredients of the present invention as well as other ingredients described herein.

Solid Detergent Compositions

According to embodiments of the invention, the solid detergent compositions according to the present invention overcome a need in the prior art by providing a dimensionally stable solid composition for use in any pressed, extruded or cast solid composition containing a hydratable salt and water. In particular, solid detergent compositions according to the present invention are useful for preparing a solid detergent composition that may be employed in any of a wide variety of situations where a dimensionally-stable solid product is desired.

In some aspects, a composition is substantially-phosphate free and/or nitrilotriacetic acid (NTA)-free. Substantially phosphate-free means a solid detergent composition having less than approximately 0.5 wt-%, more particularly, less than approximately 0.1 wt-%, and even more particularly less than approximately 0.01 wt-% phosphate based on the total weight of the solidification matrix. NTA-free means a solidification matrix having less than approximately 0.5 wt-%, less than approximately 0.1 wt-%, and often less than approximately 0.01 wt-% NTA based on the total weight of the respective solid detergent composition. In embodiments of solid detergent compositions being NTA-free, the respective solid detergent compositions are also compatible with chlorine containing components, such as active oxygen sources including hypochlorite, which may function as an anti-redeposition and stain-removal agent. Accordingly, the embodiments of the present invention providing phosphate-free and/or NTA-free solid detergent compositions are particularly useful in cleaning applications where it is desired to use an environmentally friendly solid detergent. In some embodiments according to the invention, additional functional ingredients may be included in solid detergent compositions according to the present invention, such as for example builders which may include the use of phosphonates.

Solid detergent compositions according to the present invention of the present invention may be employed in any of a wide variety of situations in which a dimensionally stable solid product is desired. They are dimensionally stable and have an appropriate rate of solidification. Solid detergent compositions according to the present invention are particularly useful in cleaning applications in need of scale-inhibition. Such applications include, but are not limited to: machine and manual warewashing, presoaks, laundry and textile cleaning and destaining, carpet cleaning and destaining, vehicle cleaning and care applications, surface cleaning and destaining, kitchen and bath cleaning and destaining, floor cleaning and destaining, cleaning in place operations, general purpose cleaning and destaining, industrial or household cleaners, and pest control agents.

In one embodiment of the present invention, solid detergent compositions according to the present invention generally include a carboxylic acid terpolymer, a hydratable salt, such as sodium carbonate (soda ash), and water for forming solid compositions. Without being bound to any specific theory, we believe that the solidification matrices of said solid detergent composition may comprise, consist of and/or consists essentially of carboxylic acid terpolymer binding agent(s), a hydratable salt and water as components.

Suitable component concentrations for solid detergent compositions according to the present invention range from between approximately 0.1% and approximately 20% by weight carboxylic acid terpolymer, between approximately 0.1% and approximately 50% by weight water, and between approximately 40% and approximately 95% by weight hydratable salt, such as sodium carbonate. Particularly suitable component concentrations for solid detergent compositions according to the present invention range from between 1% and 15% by weight carboxylic acid terpolymer, between 0.1% and 40% by weight water, and between 50% and 90% by weight sodium carbonate. More particularly suitable component concentrations for solid detergent compositions according to the present invention range from between 1% and 10% by weight carboxylic acid terpolymer, between 1% and 25% by weight water, and between 50% and 80% by weight sodium carbonate. Without limiting the scope of the invention, the numeric ranges recited are understood to be inclusive of the numbers defining the range and include each integer within the defined range.

Further description of suitable formulations of the solidification matrix is shown below:

| Solid Detergent Compositions | | | |
|---|---|---|---|
| Water | 0.1-50 wt-% | 0.1-40 wt-% | 1-25 wt-% |
| Hydratable salt (i.e. alkali metal carbonate) | 40-95 wt-% | 50-90 wt-% | 50-80 wt-% |
| Carboxylic acid terpolymer | 0.1-20 wt-% | 1-15 wt-% | 1-10 wt-% |
| Additional Functional Ingredients | 0-50 wt-% | 0-30 wt-% | 0-20 wt-% |

The proposed solidification mechanism of solid detergent compositions according to the present invention occurs through ash hydration, or the interaction of alkali metal carbonate with water. It is believed that carboxylic acid terpolymer functions to control the kinetics and thermodynamics of the solidification process and provides a solidification matrix in which additional functional materials may be bound to form a functional solid composition. Terpolymer (A) may stabilize carbonate hydrates and, optionally, a functional solid composition by acting as a donor and/or acceptor of free water. Terpolymer (A) may control the rate of solidification to provide process and dimensional stability to the solid detergent composition according to the present invention. The rate of solidification is significant because if a solidification matrix solidifies too quickly, the resulting composition may solidify during mixing and stop processing. If a solidification matrix solidifies too slowly, valuable process time is lost.

Terpolymer (A) also provides dimensional stability to product solid detergent composition by ensuring that said solid detergent composition does not swell. If product detergent composition swells after solidification, various problems may occur, including but not limited to: decreased density, integrity, and appearance; and inability to dispense or package the solid product.

In the context of the present invention, any solid product is considered to have dimensional stability if said solid product has a growth exponent of less than about 3%, preferably less than about 2%. Growth exponent refers to the percent growth or swelling of a product over a period of time after solidification under normal transport/storage conditions. Because normal transport/storage conditions for detergent products often results in the detergent composition being subjected to an elevated temperature, the growth exponent of a solid detergent product may be determined by measuring one or more dimensions of the product prior to and after heating at between about 100° F. (37° C.) and 122° F. (50° C.) and preferably kept at 122° F. (50° C.) for some time, such as at least 30 minutes, or at least one hour, or even up to two weeks. The measured dimension or dimensions depends on the shape of the solid product and the manner in which it swells. For tablets, the change in both diameter and height is generally measured and added together to determine the growth exponent representing the cumulative change in the diameter and height of the tablet after heating. For capsules, just the diameter is normally measured.

Terpolymer (A) (Carboxylic Acid Terpolymer)

The solidification matrices and the solid detergent compositions according to the invention include a terpolymer (A). Terpolymer (A) may serve as a binding agent that controls water transfer within a solid composition and/or interacts with a detergent component in a way that achieves dimensional stability.

Terpolymers (A)—hereinafter also referred to as carboxylic acid terpolymer(s)—comprise, in copolymerized form:

a1) 30 to 90% by weight of at least one monoethylenically unsaturated $C_3$-$C_8$-carboxylic acid, or an anhydride or salt thereof, a2) 3 to 60% by weight of at least one monomer comprising a sulfo group, a3) 3 to 60% by weight, and preferably up to 20% by weight of at least one nonionic monomer of the formula (I)

$$H_2C{=}C(R^1)(CH_2)_xO[R^2{-}O]_y{-}R^3 \quad (I)$$

in which $R^1$ is hydrogen or methyl, $R^2$ are identical or different, linear or branched $C_2$-$C_6$-alkylene wherein $R^2$—O may be arranged in blocks or randomly, and $R^3$ is hydrogen or a straight-chain or branched $C_1$-$C_4$-alkyl, x is 0, 1 or 2 and y is a number from 3 to 50, a4) 0 to 30% by weight of one or more further ethylenically unsaturated monomers which are polymerizable with a1), a2) and a3), where the sum of a1), a2), a3) and—if present—a4) adds up to 100% by weight.

As monomer a1), the terpolymer (A) comprises 30 to 90% by weight of at least one monoethylenically unsaturated $C_3$-$C_8$-carboxylic acid, or an anhydride or salt thereof.

Suitable unsaturated $C_3$-$C_8$-carboxylic acids are especially acrylic acid, methacrylic acid, ethacrylic acid, vinylacetic acid, allylacetic acid, crotonic acid, maleic acid, fumaric acid, mesaconic acid and itaconic acid. When the unsaturated $C_3$-$C_8$-carboxylic acids mentioned can form anhydrides, the latter are also suitable as monomers a1), for example maleic anhydride and itaconic anhydride. Suitable salts thereof are water-soluble salts, especially the sodium and the potassium salts.

Preferred monoethylenically unsaturated $C_3$-$C_8$-carboxylic acids are acrylic acid and methacrylic acid, and the water-soluble salts thereof. Water-soluble salts are especially the sodium and potassium salts of the acids.

As monomer a2), terpolymer (A) comprises 3 to 60% by weight of at least one monomer comprising a sulfo group.

Sulfo-group containing monomers are preferably those of the formulae (IIa) and (IIb)

$$H_2C{=}CH{-}X{-}SO_3H \quad (IIa)$$

$$H_2C{=}C(CH_3){-}X{-}SO_3H \quad (IIb)$$

in which X is an optionally present spacer group which may be selected from —$(CH_2)_n$— where n=0 to 4, —$C_6H_4$—, —$CH_2$—O—$C_6H_4$—, —C(O)—NH—$C(CH_3)_2$—, —C(O)—NH—$CH(CH_2CH_3)$—, —C(O)NH—$CH(CH_3)CH_2$—, —C(O)NH—$C(CH_3)_2CH_2$—, —C(O)NH—$CH_2CH(OH)CH_2$—, —C(O)NH—$CH_2$—, —C(O)NH—$CH_2CH_2$— and —C(O)NH—$CH_2CH_2CH_2$—.

Particularly preferred sulfo-containing monomers are 1-acrylamido-1-propanesulfonic acid (X=—C(O)NH—$CH(CH_2CH_3)$— in formula IIa), 2-acrylamido-2-propanesulfonic acid (X=—C(O)NH—$CH(CH_3)CH_2$— in formula IIa), 2-acrylamido-2-methylpropanesulfonic acid (AMPS, X=—C(O)NH—$C(CH_3)_2$ $CH_2$— in formula IIa), 2-methacrylamido-2-methyl-propanesulfonic acid (X=—C(O)NH—$C(CH_3)_2$ $CH_2$— in formula IIb), 3-methacrylamido-2-hydroxypropanesulfonic acid (X=—C(O)NH—$CH_2CH$ (OH)$CH_2$— in formula IIb), allylsulfonic acid (X=$CH_2$ in formula IIa), methallylsulfonic acid (X=$CH_2$ in formula IIb), allyloxybenzenesulfonic acid (X=—$CH_2$—O—$C_6H_4$— in formula IIa), methallyloxybenzenesulfonic acid (X=—$CH_2$—O—$C_6H_4$— in formula IIb), 2-hydroxy-3-(2-propenyloxy)propanesulfonic acid, 2-methyl-2-propene-1-sulfonic acid (X=$CH_2$ in formula IIb), styrenesulfonic acid (X=$C_6H_4$ in formula IIa), vinylsulfonic acid (X absent in formula IIa), 3-sulfopropyl acrylate (X=—C(O)O—$CH_2CH_2CH_2$— in formula IIa), 2-sulfoethyl methacrylate (X=—C(O)O—$CH_2CH_2$— in formula IIb), 3-sulfopropyl methacrylate (X=—C(O)O—$CH_2CH_2CH_2$— in formula IIb), sulfomethacrylamide (X=—C(O)NH— in formula IIb), sulfomethylmethacrylamide (X=—C(O)NH—$CH_2$— in formula IIb) and salts of the acids mentioned. Suitable salts are generally water-soluble salts, preferably the sodium, potassium and ammonium salts of the acids mentioned.

Especially preferred are 1-acrylamidopropanesulfonic acid, 2-acrylamido-2-propanesulfonic acid, 2-acrylamido-2-methylpropanesulfonic acid (AMPS), 2-methacrylamido-2-methylpropanesulfonic acid, 3-methacrylamido-2-hydroxypropanesulfonic acid, 2-hydroxy-3-(2-propenyloxy) propanesulfonic acid, 2-sulfoethyl methacrylate, styrenesulfonic acid, vinylsulfonic acid, allylsulfonic acid (ALS) and methallylsulfonic acid, and salts of the acids mentioned.

Very particularly preferred sulfo-containing monomers are 2-acrylamido-2-methylpropanesulfonic acid (AMPS) and allylsulfonic acid, and the water-soluble salts thereof, especially the sodium, potassium and ammonium salts thereof.

As monomer a3), terpolymer (A) comprises 3 to 60% by weight, preferably up to 20% by weight of at least one nonionic monomer of the formula (I)

$$H_2C{=}C(R^1)(CH_2)_xO[R^2{-}O]_y{-}R^3 \quad (I)$$

in which $R^1$ is hydrogen or methyl, $R^2$ is identical or different $C_2$-$C_6$-alkylene wherein $R^2$—O may be linear or branched and arranged in blocks or randomly, and $R^3$ is hydrogen or a straight-chain or branched $C_1$-$C_4$-alkyl, x is 0, 1, 2 and y is from 3 to 50.

The alkylene oxide units ($R^2$—O) may also be arranged in blocks and randomly, i.e. in one or more blocks of identical alkylene oxide and additionally randomly in one or more blocks of two or more different alkylene oxide. This is also included by the wording "arranged in blocks or randomly".

Preferred nonionic monomers a3) are those based on allyl alcohol ($R^1$=H; x=1) and isoprenol ($R^1$=methyl; x=2).

The nonionic monomer a3) comprises preferably an average of 8 to 40, more preferably 10 to 30, especially 10 to 25, alkylene oxide units. The index y in formula (I) is based on the mean number of alkylene oxide units.

Preferred alkylene oxide units $R^2$—O are ethylene oxide, 1,2-propylene oxide and 1,2-butylene oxide, particular preference being given to ethylene oxide and 1,2-propylene oxide.

In a specific embodiment, the nonionic monomers a3) comprise only ethylene oxide units as alkylene oxide units ($R^2$—O). In a further specific embodiment, the nonionic monomers a3) comprise ethylene oxide and 1,2-propylene oxide units, which may be arranged in blocks or randomly.

$R^3$ is preferably hydrogen or methyl.

As component a4), terpolymer (A) may comprise 0 to 30% by weight of one or more further ethylenically unsaturated monomers polymerizable with a1), a2) and a3).

Useful further ethylenically unsaturated monomers a4) include, for example, acrylamide, t-butylacrylamide, vinyl acetate, vinyl methyl ether, hydroxybutyl vinyl ether, 1-vinylpyrrolidone, 1-vinylcaprolactam, 1-vinylimidazole, 2-vinylpyridine, 4-vinylpyridine, methyl methacrylate, ethyl acrylate, isobutene, diisobutene, isoprenol, 1-alkenes such as 1-octene, N,N-dimethylacrylamide and styrene.

The proportion of copolymerized monomers a1), especially of copolymerized acrylic acid, methacrylic acid or of a water-soluble salt of these acids, is preferably 40 to 90% by weight, more preferably 45 to 85% by weight and especially preferably 50 to 85% by weight. The proportion of copolymerized monomers a2), especially of copolymerized 2-acrylamido-2-methylpropanesulfonic acid, is preferably 4 to 40% by weight, more preferably 6 to 35% by weight and especially preferably 8 to 32% by weight. The proportion of monomer a3) is preferably 4 to 20% by weight, more preferably 5 to 15% by weight and especially up to 12% by weight.

If monomers a4) are present in terpolymer (A), the proportion thereof is preferably up to 20% by weight, more preferably up to 15% by weight and especially up to 10% by weight.

Terpolymer (A) preferably has a mean molecular weight $M_w$ of 1,000 to 200,000 g/mol, preferably of 1,000 to 100,000 g/mol, more preferably of 1,000 to 50,000 g/mol, determined by gel permeation chromatography at room temperature with a buffer solution (pH value 7) as an eluent against polyacrylate standards.

The K values thereof are 15 to 100, preferably 20 to 80, more preferably 30 to 50, measured at pH 7 in 1% by weight aqueous solution at 25° C. according to H. Fikentscher, Cellulose-Chemie volume 13, pages 58-64 and 71-74 (1932).

Terpolymers (A) can be prepared by free-radical polymerization of the monomers. It is possible to work by any known free-radical polymerization process. In addition to polymerization in bulk, mention should be made especially of the processes of solution polymerization and emulsion polymerization, preference being given to solution polymerization.

The polymerization is preferably performed in water as a solvent. However, it can also be undertaken in alcoholic solvents, especially $C_1$-$C_4$-alcohols, such as methanol, ethanol and isopropanol, or mixtures of these solvents with water.

Suitable polymerization initiators are compounds which decompose thermally, by a redox mechanism or photochemically (photoinitiators) to form free radicals.

Among the thermally active polymerization initiators, preference is given to initiators having a decomposition temperature in the range from 20 to 180° C., especially from 50 to 90° C. Examples of suitable thermal initiators are inorganic peroxo compounds such as peroxodisulfates (ammonium peroxodisulfate and preferably sodium peroxodisulfate), peroxosulfates, percarbonates and hydrogen peroxide; organic peroxo compounds such as diacetyl peroxide, di-tert-butyl peroxide, diamyl peroxide, dioctanoyl peroxide, didecanoyl peroxide, dilauroyl peroxide, dibenzoyl peroxide, bis(o-tolyl) peroxide, succinyl peroxide, tert-butyl pemeodecanoate, tert-butyl perbenzoate, tert-butyl perisobutyrate, tert-butyl perpivalate, tert-butyl peroctoate, tert-butyl pemeodecanoate, tert-butyl perbenzoate, tert-butyl peroxide, tert-butyl hydroperoxide, cumene hydroperoxide, tert-butyl peroxy-2-ethylhexanoate and diisopropyl peroxydicarbamate; azo compounds such as 2,2'-azobisisobutyronitrile, 2,2'-azobis(2-methylbutyronitrile) and azobis(2-amidopropane) dihydrochloride.

Any of the above initiators can be used in combination with reducing compounds as initiator/regulator systems. Examples of such reducing compounds include phosphorus compounds such as phosphorous acid, hypophosphites and phosphinates, sulfur compounds such as sodium hydrogensulfite, sodium sulfite and sodium formaldehyde-sulfoxylate, and hydrazine.

Also frequently used are redox initiator systems which consist of a peroxo compound, a metal salt and a reducing agent. Examples of suitable peroxo compounds are hydrogen peroxide, peroxodisulfate (as the ammonium, sodium or potassium salt), peroxosulfates, and organic peroxo compounds such as tert-butyl hydroperoxide, cumene hydroperoxide or dibenzoyl peroxide. Suitable metal salts are in particular iron(II) salts such as iron(II) sulfate heptahydrate. Suitable reducing agents are sodium sulfite, the disodium salt of 2-hydroxy-2-sulfinatoacetic acid, the disodium salt of 2-hydroxy-2-sulfonatoacetic acid, sodium hydroxymethanesulfinate, ascorbic acid, isoascorbic acid or mixtures thereof.

Examples of suitable photoinitiators are benzophenone, acetophenone, benzyl dialkyl ketones and derivatives thereof.

Preference is given to using thermal initiators, preference being given to inorganic peroxo compounds, especially sodium peroxodisulfate. The peroxo compounds are particularly advantageously used in combination with sulfur-containing reducing agents, especially sodium hydrogensulfite, as the redox initiator system. In the case of use of this initiator/regulator system, copolymers comprising —$SO_3$—Na+ and/or —$SO_4$-Na+ as end groups are obtained, which are notable for exceptional cleaning power and scale-inhibiting action.

Alternatively, it is also possible to use phosphorus-containing initiator/regulator systems, for example hypophosphites/phosphinates.

The amounts of photoinitiator and initiator/regulator system should be matched to the substances used in each case. If, for example, the preferred peroxodisulfate/hydrogensulfite system is used, typically 2 to 6% by weight, preferably 3 to 5% by weight, of peroxodisulfate and generally 5 to 30% by weight, preferably 5 to 10% by weight, of hydrogensulfite are used, based in each case on the monomers a1), a2), a3) and optionally a4).

If desired, it is also possible to use polymerization regulators. Suitable examples are sulfur compounds such as mercaptoethanol, 2-ethylhexyl thioglycolate, thioglycolic acid and dodecyl mercaptan. When polymerization regulators are used, the amount thereof used is generally 0.1 to 15% by weight, preferably 0.1 to 5% by weight and more preferably 0.1 to 2.5% by weight, based on monomers a1), a2), a3) and optionally a4).

The polymerization temperature is generally 20 to 200° C., preferably 20 to 150° C., and more preferably 20 to 120° C.

The polymerization can be performed under atmospheric pressure, but is preferably undertaken in a closed system under the autogenous pressure which evolves.

Terpolymers (A) can be obtained in the acidic state, but they can also, if desired for the application, be neutralized or partly neutralized by addition of bases, especially of sodium hydroxide solution, as early as during the polymerization or after the polymerization has ended. The preferred pH of the aqueous solutions is in the range from 3 to 8.5.

Terpolymers (A) used in accordance with the invention can be used directly in the form of the aqueous solutions obtained in the course of preparation by means of solvent polymerization in water, or in dried form (obtained, for example, by spray drying, spray granulation, fluidized spray drying, roller drying or freeze drying) for manufacture of inventive solid detergent compositions.

In an aspect monomers for terpolymer (A) are provided in the following weight ratios for polymerization. The use of percentages shown below refers to weight of the total terpolymer (A) composition.

| Terpolymer (A) | | | |
|---|---|---|---|
| a1 (e.g. acrylic acid, methacrylic acid or a water soluble salt thereof) | 30-90 wt-% | 45-85 wt-% | 50-85 wt-% |
| a2 (e.g. AMPS) | 3-60 wt-% | 6-35 wt-% | 8-32 wt-% |
| a3 (e.g. Formula I) | 3-60 wt-% | 6-35 wt-% | 8-32 wt-% |
| a4 | 0-20 wt-% | 0-15 wt-% | 0-10 wt-% |

Additional disclosure of the carboxylic acid terpolymers, including methods of making and formulations employing the same, are set forth in further detail in U.S. Publication No. 2012/0129749 which is herein incorporated by reference in its entirety.

In a further aspect of the invention, the carboxylic acid terpolymers may include additional monomer units, in addition to those units a1, a2, a3, and a4 described herein, to the extent the additional monomer unit(s) do not interfere with the solidification of the solid detergent compositions and/or the additional performance benefits described herein. In a preferred aspect, the acrylic acid terpolymers do not include additional monomer units.

In some embodiments of the invention the solid detergent compositions are nitrilotriacetic acid (NTA)-free to meet certain regulations. In additional aspects of the invention the stability enhancement agent and/or the solid detergent compositions may be substantially phosphate free, or contain low amounts of phosphate-containing compounds, to meet certain regulations. Preferably, the amount of phosphate in a solid detergent composition according to the invention may be less than about 0.5% by weight, more preferably less than 0.1 wt-%. In other embodiments, solid detergent compositions employing the carboxylic acid terpolymer may include additional functional ingredients employing phosphonates and/or other phosphorus-containing components and still provide low-phosphorus containing compounds, including for example less than about 20 wt-%, less than about 10 wt-%, less than about 5 wt-%, or less than about 1 wt-% phosphonates and/or other phosphorus-containing components. It is a benefit of the solid detergent compositions of the present invention to provide detergent compositions capable of controlling the redeposition of soils on a substrate surface (e.g. anti-redeposition). It is a further benefit of the solid detergent compositions of the present invention to control water hardness scale (e.g. calcium carbonate scale) in detergent applications. In particular, hardness scale is controlled without the use of phosphates, such as tripolyphosphates, commonly used in detergents to prevent hardness scale and/or accumulation. Additional benefits of the detergency effects according to the invention are disclosed in U.S. Pat. No. 9,127,235, which is herein incorporated by reference in its entirety.

Beneficially, in an aspect of the invention, the carboxylic acid terpolymers provide an efficient replacement for soil dispersant detergent polymers, such as for example those commercially-available from Dow Chemical as Acusol® 492N, Acusol® 505N, Acusol® 470N, and/or Acusol® 425N.

Hydratable Salts

The solid detergent compositions according to the invention comprise at least one hydratable salt. In an embodiment the hydratable salt is an alkali metal carbonate. In one embodiment the hydratable salt is sodium carbonate (soda ash or ash). Alkali metal carbonate is provided in the ranges from between approximately 40% and approximately 95% by weight, preferably between approximately 50% and approximately 90% by weight, more preferably between approximately 50% and approximately 80% by weight hydratable salt, such as sodium carbonate. Without limiting the scope of the invention, the numeric ranges recited are understood to be inclusive of the numbers defining the range and include each integer within the defined range.

In further embodiments, the compositions can include a secondary hydratable salt for a solid detergent composition according to the present invention. For example, the secondary hydratable salt may be inorganic in nature and may also act optionally as a source of alkalinity. In certain embodiments, the secondary hydratable salt agent may include, but are not limited to: alkali metal hydroxides, alkali metal phosphates, anhydrous sodium sulfate, anhydrous sodium acetate, and other known hydratable inorganic compounds or combinations thereof. According to a preferred embodiment, the secondary hydratable salt comprises sodium metasilicate or combinations thereof. The amount of secondary hydratable salt necessary to enhance solidification depends upon several factors, including the exact solidifying agent employed, the amount of water in the composition, and the hydration capacity of the other detergent components. In certain embodiments, the secondary solidifying agent may also serve as an alkaline source.

Water

The solid detergent compositions according to the invention may comprise water in amounts that vary depending upon techniques for processing the solid composition which may comprise a pressed, extruded and/or cast solid detergent composition.

Water may be independently added to the solidification matrix or may be provided in the solidification matrix as a result of its presence in an aqueous material that is added to generate the solid detergent composition. For example, materials added to the detergent composition may include water or may be prepared in an aqueous premix available for reaction with the solidification matrix component(s). Typically, water is introduced into the solidification matrix to provide the solidification matrix with a desired viscosity for processing prior to solidification and to provide a desired rate of solidification. The water may also be present as a processing aid and may be removed or become water of hydration. The water may thus be present in the form of aqueous solutions of the solidification matrix, or aqueous solutions of any of the other ingredients, and/or added aqueous medium as an aid in processing. In addition, it is expected that the aqueous medium may help in the solidification process when is desired to form the concentrate as a solid. The water may also be provided as deionized water or as softened water.

The amount of water in the resulting solid detergent composition will depend on whether the solid detergent composition is processed through forming techniques or casting (solidification occurring within a container) techniques. In general, when the components are processed by forming techniques, it is believed that the solid detergent composition can include a relatively smaller amount of water for solidification compared with the casting techniques. When preparing the solid detergent composition by forming techniques, water may be present in ranges of between about 0% and about 50% by weight, between about 0.1% and about 40% by weight, between about 1% and about 10% by weight, particularly between about 5% and about 10% by weight, and more particularly between about 8% and about 10% by weight. When preparing the solid detergent composition by casting techniques, water may be present in the ranges of between about 15% and about 50% by weight, particularly between about 20% and about 45% by weight, and more particularly between about 22% and about 40% by weight. Without limiting the scope of the invention, the numeric ranges recited are understood to be inclusive of the numbers defining the range and include each integer within the defined range.

Additional Functional Materials

The components of the solidification matrix can be combined with various functional components used to form a solid detergent composition. In some embodiments, the solidification matrix including the terpolymer (A), water, and alkali metal carbonate (e.g. sodium carbonate) make up a large amount, or even substantially all of the total weight of the solid detergent composition, for example, in embodiments having few or no additional functional materials disposed therein. In these embodiments, the component concentrations ranges provided above for the solidification matrix are representative of the ranges of those same components in the detergent composition.

For the purpose of this application, the term "functional materials" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional materials may be used. For example, many of the functional materials discussed below relate to materials used in cleaning and/or destaining applications. However, other embodiments may include functional materials for use in other applications.

Alkaline Source

The solid detergent composition can include an effective amount of one or more alkaline sources to enhance cleaning of a substrate and improve soil removal performance of the solid detergent composition. In general, it is expected that the composition will include the alkaline source in an amount of at least about 5% by weight, at least about 10% by weight, or at least about 15% by weight. In order to provide sufficient room for other components in the concentrate, the alkaline source can be provided in the concentrate in an amount of less than about 75% by weight, less than about 60% by weight, less than about 40% by weight, less than about 30% by weight, or less than about 20% by weight. The alkalinity source may constitute between about 0.1% and about 90% by weight, between about 0.5% and about 80% by weight, and between about 1% and about 60% by weight of the total weight of the solid detergent composition.

An effective amount of one or more alkaline sources should be considered as an amount that provides a use composition having a pH of at least about 8, preferably at least about 9, more preferably at least about 10, and still more preferably between about 9.5 and 14. When the use composition has a pH of between about 8 and about 10, it can be considered mildly alkaline, and when the pH is greater than about 12, the use composition can be considered caustic.

Examples of suitable alkaline sources of the solid detergent composition include, but are not limited to an alkali metal carbonate and an alkali metal hydroxide. Exemplary alkali metal carbonates that can be used include, but are not limited to: sodium or potassium carbonate, bicarbonate, sesquicarbonate, and mixtures thereof. Exemplary alkali metal hydroxides that can be used include, but are not limited to sodium, lithium, or potassium hydroxide. The alkali metal hydroxide may be added to the composition in any form known in the art, including as solid beads, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 45% and a 50% by weight solution. It is preferred that the alkali metal hydroxide is added in the form of an aqueous solution, particularly a 50% by weight hydroxide solution, to reduce the amount of heat generated in the composition due to hydration of the solid alkali material.

In addition to the first alkalinity source, the solid detergent composition may comprise a secondary alkalinity source. Examples of useful secondary alkaline sources include, but are not limited to: metal silicates such as sodium or potassium silicate or metasilicate; metal carbonates, such as sodium or potassium carbonate, metal bicarbonate, metal sesquicarbonate, and mixtures thereof; metal borates such as sodium or potassium borate; and ethanolamines and amines. Such alkalinity agents are commonly available in either aqueous or powdered form, either of which is useful in formulating the present solid detergent compositions.

Surfactants

Detergent compositions according to the present invention can include at least one surfactant or surfactant system. A variety of surfactants can be used in the inventive solid detergent compositions, including, but not limited to: nonionic, anionic, cationic, amphoteric and zwitterionic surfactants. Surfactants are an optional component of the solid detergent composition and can be excluded from the concentrate. Exemplary surfactants that can be used are commercially available from a number of sources.

For a discussion of surfactants, see Kirk-Othmer, Encyclopedia of Chemical Technology, Third Edition, volume 8, pages 900-912, which is herein incorporated by reference in its entirety. When the solid detergent composition includes a cleaning agent, the cleaning agent is provided in an amount effective to provide a desired level of cleaning. The solid detergent composition, when provided as a concentrate, can include surfactant in a range of about 0.1% to about 10% by weight, about 0.5% to about 10% by weight, about 1% to about 10% by weight, about 1.5% to about 10% by weight, and about 2% to about 8% by weight. Additional exemplary ranges of surfactant in a concentrate include about 0.5% to about 8% by weight, and about 1% to about 5% by weight. Without limiting the scope of the invention, the numeric ranges recited are understood to be inclusive of the numbers defining the range and include each integer within the defined range.

In other embodiments, the compositions of the present invention include about 0-40 wt-% of a surfactant. In other embodiments the compositions of the present invention include about 0-25 wt-% of a surfactant.

In certain embodiments of the invention the detergent composition does not require a surfactant and/or other polymer in addition to the terpolymer (A). In alternative embodiments, the detergent compositions employ a nonionic surfactant, which may beneficially provide defoaming properties to the composition. In an embodiment, the detergent composition employs an alkoxylated surfactant and/or an EO/PO copolymers), such as a fatty alcohol alkoxylate and/or EO/PO derivatives.

Nonionic Surfactants

Suitable nonionic surfactants suitable for use with the solid detergent compositions of the present invention include alkoxylated surfactants. In an embodiment, the nonionic surfactant is a linear or branched alcohol alkoxylate. Suitable alkoxylated surfactants include EO/PO copolymers, capped EO/PO copolymers, alcohol alkoxylates, capped alcohol alkoxylates, mixtures thereof, or the like. Suitable alkoxylated surfactants for use as solvents include EO/PO block copolymers, such as the Pluronic® and reverse Pluronic® surfactants; alcohol alkoxylates; capped alcohol alkoxylates; mixtures thereof, or the like.

Useful nonionic surfactants are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties.

Block polyoxypropylene-polyoxyethylene polymeric compounds based upon propylene glycol, ethylene glycol, glycerol, trimethylolpropane, and ethylenediamine as the initiator reactive hydrogen compound are suitable nonionic surfactants. Examples of polymeric compounds made from a sequential propoxylation and ethoxylation of initiator are commercially available under the trade names Pluronic® and Tetronic® manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from about 1,000 to about 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from about 500 to about 7,000; and, the hydrophile, ethylene oxide, is added to constitute from about 10% by weight to about 80% by weight of the molecule.

Semi-Polar Nonionic Surfactants

The semi-polar type of nonionic surface active agents is another class of nonionic surfactant useful in solid detergent compositions of the present invention. Semi-polar nonionic surfactants include the amine oxides, phosphine oxides, sulfoxides and their alkoxylated derivatives.

Amine oxides are tertiary amine oxides corresponding to the general formula:

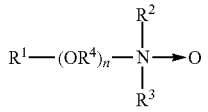

wherein the arrow is a conventional representation of a semi-polar bond; and, $R^1$, $R^2$, and $R^3$ of the amine oxides may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkylene or a hydroxyalkylene group containing 2 to 3 carbon atoms; and n ranges from 0 to about 20. An amine oxide can be generated from the corresponding amine and an oxidizing agent, such as hydrogen peroxide.

Useful semi-polar nonionic surfactants also include the water soluble phosphine oxides having the following structure:

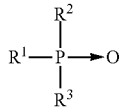

wherein the arrow is a conventional representation of a semi-polar bond; and, $R^1$ of the phosphine oxide is an alkyl, alkenyl or hydroxyalkyl moiety ranging from 10 to about 24 carbon atoms in chain length; and, $R^2$ and $R^3$ of the phosphine oxide are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide. Useful water soluble amine oxide surfactants are selected from the octyl, decyl, dodecyl, isododecyl, coconut, or tallow alkyl di-(lower alkyl) amine oxides, specific examples of which are octyldimethylamine oxide, nonyldimethylamine oxide, decyldimethylamine oxide, undecyldimethylamine oxide, dodecyldimethylamine oxide, iso-dodecyldimethyl amine oxide, tridecyldimethylamine oxide, tetradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Semi-polar nonionic surfactants useful herein also include the water soluble sulfoxide compounds which have the structure:

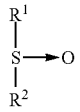

wherein the arrow is a conventional representation of a semi-polar bond; and, $R^1$ of the sulfoxide compound is an alkyl or hydroxyalkyl moiety of about 8 to about 28 carbon atoms, from 0 to about 5 ether linkages and from 0 to about 2 hydroxyl substituents; and $R^2$ of the sulfoxide compound is an alkyl moiety consisting of alkyl and hydroxyalkyl groups having 1 to 3 carbon atoms. Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Preferred semi-polar nonionic surfactants for the compositions of the invention include dimethyl amine oxides, such as lauryl dimethyl amine oxide, myristyl dimethyl amine oxide, cetyl dimethyl amine oxide, combinations thereof, and the like. Alkoxylated amines or, most particularly, alcohol alkoxylated/aminated/alkoxylated surfactants are also suitable for use according to the invention. These non-ionic surfactants may be at least in part represented by the general formulae: $R^{20}$—$(PO)_sN$-$(EO)_tH$, $R^{20}$—$(PO)_sN$-$(EO)_tH(EO)_tH$, and $R^{20}$—$N(EO)_tH$; in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula: $R^{20}$—$(PO)_v$—N$[(EO)_wH][(EO)_zH]$ in which $R^{20}$ is as defined above, v is 1 to 20 (e.g., 1, 2, 3, or 4 (preferably 2)), and w and z are independently 1-10, preferably 2-5. These compounds are represented commercially by a line of products sold by Huntsman Chemicals as nonionic surfactants.

Anionic Surfactants

Anionic sulfate surfactants suitable for use in the solid detergent compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside, and the like. Also included are the alkyl sulfates, alkyl poly(ethyleneoxy) ether sulfates and aromatic poly(ethyleneoxy) sulfates such as the sulfates or condensation products of ethylene oxide and nonyl phenol (usually having 1 to 6 oxyethylene groups per molecule).

Anionic sulfonate surfactants suitable for use in the present compositions also include alkyl sulfonates, the linear and branched primary and secondary alkyl sulfonates, and the aromatic sulfonates with or without substituents.

Anionic carboxylate surfactants suitable for use in the present compositions include carboxylic acids (and salts), such as alkanoic acids (and alkanoates), ester carboxylic acids (e.g. alkyl succinates), ether carboxylic acids, and the like. Such carboxylates include alkyl ethoxy carboxylates, alkyl aryl ethoxy carboxylates, alkyl polyethoxy polycarboxylate surfactants and soaps (e.g. alkyl carboxyls). Secondary carboxylates useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary carboxylate surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present. Suitable carboxylates also include acylamino acids (and salts), such as acylgluamates, acyl peptides, sarcosinates (e.g. N-acyl sarcosinates), taurates (e.g. N-acyl taurates and fatty acid amides of methyl tauride), and the like.

Suitable anionic surfactants include alkyl or alkylaryl ethoxy carboxylates of the following formula:

$$R—O—(CH_2CH_2O)_n(CH_2)_m—CO_2X \quad (3)$$

in which R of the alkyl or alkylaryl ethoxy carboxylate is a $C_8$ to $C_{22}$ alkyl group or

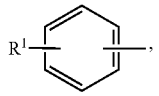

in which $R^1$ of the alkyl or alkylaryl ethoxy carboxylate is a $C_4$-$C_{16}$ alkyl group; n is an integer of 1-20; m is an integer of 1-3; and X is a counter ion, such as hydrogen, sodium, potassium, lithium, ammonium, or an amine salt such as monoethanolamine, diethanolamine or triethanolamine. In some embodiments, n is an integer of 4 to 10 and m is 1. In some embodiments, R of the alkyl or alkylaryl ethoxy carboxylates is a $C_8$-$C_{16}$ alkyl group. In some embodiments, R of the alkyl or alkylaryl ethoxy carboxylates is a $C_{12}$-$C_{14}$ alkyl group, n is 4, and m is 1.

In other embodiments, R of the alkyl or alkylaryl ethoxy carboxylates is

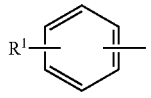

and $R^1$ of the alkyl or alkylaryl ethoxy carboxylates is a $C_6$-$C_{12}$ alkyl group. In still yet other embodiments, $R^1$ of the alkyl or alkylaryl ethoxy carboxylates is a $C_9$ alkyl group, n is 10 and m is 1.

Such alkyl and alkylaryl ethoxy carboxylates are commercially available. These ethoxy carboxylates are typically available as the acid forms, which can be readily converted to the anionic or salt form. Commercially available carboxylates include, Neodox 23-4, a $C_{12-13}$ alkyl polyethoxy (4) carboxylic acid (Shell Chemical), and Emcol CNP-110, a $C_9$ alkylaryl polyethoxy (10) carboxylic acid (Witco Chemical). Carboxylates are also available from Clariant, e.g. the product Sandopan® DTC, a $C_{13}$ alkyl polyethoxy (7) carboxylic acid.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, or phosphonate groups may provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphino. Amphoteric surfactants are subdivided into two major classes known to those of skill in the art and described in "Surfactant Encyclopedia" Cosmetics & Toiletries, Vol. 104 (2) 69-71 (1989), which is herein incorporated by reference in its entirety. The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

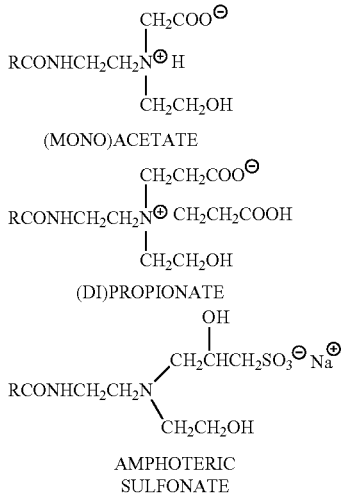

Neutral pH-Zwitterion wherein R of such imidazole derivatives is an acyclic hydrophobic group, for example alkyl, containing from about 8 to 18 carbon atoms and M of such imidazole derivatives is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Amphocarboxylic acids can be produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reacting $RNH_2$, in which R is selected from $C_8$-$C_{18}$ straight or branched chain alkyl, with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In an embodiment, M is a cation to neutralize the charge of the anion.

Suitable amphoteric surfactants include those derived from coconut products such as coconut oil or coconut fatty acid. Additional suitable coconut derived surfactants include as part of their structure an ethylenediamine moiety, an alkanolamide moiety, an amino acid moiety, e.g., glycine, or a combination thereof; and an aliphatic substituent of from about 8 to 18 (e.g., 12) carbon atoms. Such a surfactant can also be considered an alkyl amphodicarboxylic acid. These amphoteric surfactants can include chemical structures represented as: $C_{12}$-alkyl-C(O)—NH—$CH_2$—$CH_2$—N+($CH_2$—$CH_2$—$CO_2Na)_2$—$CH_2$—$CH_2$—OH or $C_{12}$-alkyl-C(O)—N(H)—$CH_2$—$CH_2$—N+($CH_2$—$CO_2Na)_2$—$CH_2$—$CH_2$—OH. Disodium cocoampho dipropionate is one suitable amphoteric surfactant and is commercially available under the tradename Miranol™ FBS from Rhodia Inc., Cranbury, N.J. Another suitable coconut derived amphoteric surfactant with the chemical name disodium cocoampho diacetate is sold under the tradename Mirataine™ JCHA, also from Rhodia Inc., Cranbury, N.J. A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch), which is herein incorporated by reference in its entirety.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y— and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution. The simplest cationic amines, amine salts and quaternary ammonium compounds can be schematically drawn thus:

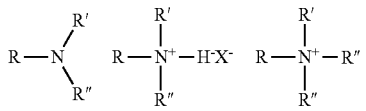

in which, R represents an alkyl chain, R', R", and R'" may be either alkyl chains or aryl groups or hydrogen and X represents an anion. The amine salts and quaternary ammonium compounds are preferred for practical use in this invention due to their high degree of water solubility. The majority of large volume commercial cationic surfactants can be subdivided into four major classes and additional sub-groups known to those or skill in the art and described in "Surfactant Encyclopedia", Cosmetics & Toiletries, Vol. 104 (2) 86-96 (1989), which is herein incorporated by reference in its entirety. The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like.

Cationic surfactants are known to have a variety of properties that can be beneficial in the present compositions. These desirable properties can include detergency in compositions of or below neutral pH, antimicrobial efficacy, thickening or gelling in cooperation with other agents, and the like. Cationic surfactants useful in the compositions of the present invention include those having the formula R1mR2xYLZ wherein each $R^1$ is an organic group containing a straight or branched alkyl or alkenyl group optionally substituted with up to three phenyl or hydroxy groups and optionally interrupted by up to four of the following structures:

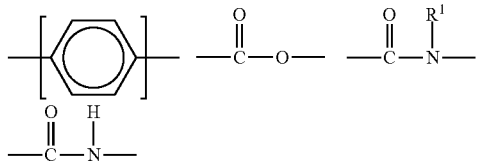

or an isomer or mixture of these structures, and which contains from about 8 to 22 carbon atoms. The $R^1$ groups of the cationic surfactants can additionally contain up to 12 ethoxy groups. m is a number from 1 to 3. Preferably, no more than one $R^1$ group in a molecule has 16 or more carbon atoms when m is 2 or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens. Y is can be a group including, but not limited to:

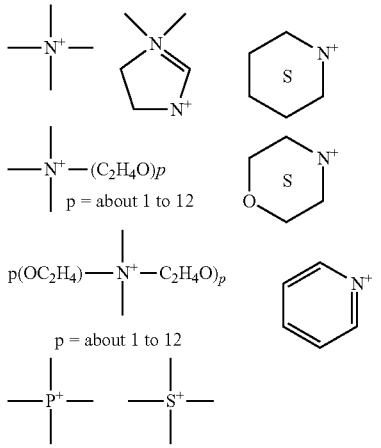

or a mixture thereof. Preferably, L is 1 or 2, with the Y groups being separated by a moiety selected from $R^1$ and $R^2$ analogs (preferably alkylene or alkenylene) having from 1 to about 22 carbon atoms and two free carbon single bonds when L is 2. Z is a water soluble anion, such as a halide, sulfate, methylsulfate, hydroxide, or nitrate anion, particularly preferred being chloride, bromide, iodide, sulfate or methyl sulfate anions, in a number to give electrical neutrality of the cationic component.

Zwitterionic Surfactants

Zwitterionic surfactants can be thought of as a subset of the amphoteric surfactants and can include an anionic charge. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate.

Betaine and sultaine surfactants are exemplary zwitterionic surfactants for use herein. A general formula for these compounds is:

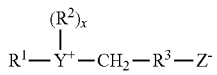

wherein $R^1$ is selected from alkyl, alkenyl, or hydroxyalkyl of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, and phosphonate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

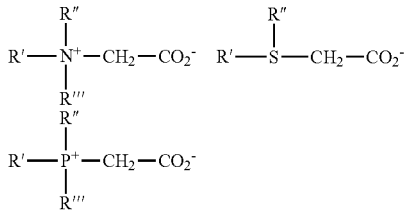

R represents for example a long alkyl chain, R', R", and R'" may be either long alkyl chains or smaller alkyl or aryl groups or hydrogen and X represents an anion. These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678, which is herein incorporated by reference in its entirety. Further examples are given in "Surface Active Agents and Detergents" (Vol. I and II by Schwartz, Perry and Berch), which is herein incorporated by reference in its entirety.

Detergent Builders

The composition can include one or more building agents, also called chelating or sequestering agents (e.g., builders), including, but not limited to: alkali metal carbonates, phosphonates, aminocarboxylic acids, and/or polyacrylates. In general, a chelating agent is a molecule capable of coordinating (i.e., binding) the metal ions commonly found in natural water to prevent the metal ions from interfering with the action of the other detersive ingredients of a cleaning composition. Preferable levels of addition for builders that can also be chelating or sequestering agents are between about 0.1% to about 70% by weight, about 1% to about 60% by weight, or about 1% to about 50% by weight. If the solid composition is provided as a concentrate, the concentrate can include between approximately 1% to approximately 60% by weight, between approximately 3% to approximately 50% by weight, and between approximately 6% to approximately 45% by weight of the builders. Additional ranges of the builders include between approximately 3% to approximately 20% by weight, between approximately 6% to approximately 15% by weight, between approximately 25% to approximately 50% by weight, and between approximately 35% to approximately 45% by weight.

According to a preferred aspect of the invention, a phosphonate builder is employed in the solid detergent compositions, such as commercially available under the tradename Dequest. Examples of phosphonate builders include, but are not limited to: 2-phosphinobutane-1,2,4-tricarboxylic acid (PBTC), 1-hydroxyethane-1, 1-diphosphonic acid, 1-hydroxyethylidene-1,1,-diphosphonic acid, $CH_2C(OH)[PO(OH)_2]_2$; aminotri(methylenephosphonic acid), $N[CH_2 PO(OH)_2]_3$; aminotri(methylenephosphonate), sodium salt (ATMP), $N[CH_2 PO(ONa)_2]_3$; 2-hydroxyethyliminobis (methylenephosphonic acid), $HOCH_2CH_2 N[CH_2PO(OH)_2]_2$; diethylenetriaminepenta(methylenephosphonic acid), $(HO)_2POCH_2 N[CH_2 CH_2 N[CH_2 PO(OH)_2]_2]_2$; diethylenetriaminepenta(methylenephosphonate), sodium salt (DTPMP), $C_9 H_{(28-x)} N_3 Na_x O_{15} P_5$ (x=7); hexamethylenediamine(tetramethylenephosphonate), potassium salt, $CloH_{(28-x)} N_2K_x O_{12} P_4$ (x=6); bis(hexamethylene)triamine (pentamethylenephosphonic acid), $(HO_2)POCH_2 N[(CH_2)_2N[CH_2 PO(OH)_2]_2]_2$; and phosphorus acid, $H_3PO_3$. Preferred phosphonates are PBTC, HEDP, ATMP and DTPMP. A neutralized or alkali phosphonate, or a combination of the phosphonate with an alkali source prior to being added into the mixture such that there is little or no heat or gas generated by a neutralization reaction when the phosphonate is added is preferred. In one embodiment, however, the composition is phosphate-free.

Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), methylglycinediacetic acid (MGDA), glutamic acid-N,N-diacetic acid (GLDA), ethylenediaminesuccinic acid (EDDS), 2-hydroxyethyliminodiacetic acid (HEIDA), iminodisuccinic acid (IDS), 3-hydroxy-2-2'-iminodisuccinic acid (HIDS) and other similar acids or salts thereof having an amino group with a carboxylic acid substituent. In one embodiment, however, the composition is free of aminocarboxylates.

Detergent compositions according to the present invention may contain a non-phosphate based builder. Although various components may include trace amounts of phosphorous, a composition that is considered free of phosphate generally does not include phosphate or phosphonate builder or chelating components as an intentionally added component. In another aspect, a composition that is considered free of phosphate generally does not include phosphate builder or chelating components as an intentionally added component. Carboxylates such as citrate, tartrate or gluconate are suitable. Water conditioning polymers can be used as non-phosphorus containing builders. Exemplary water conditioning polymers include, but are not limited to: polycarboxylates. Exemplary polycarboxylates that can be used as builders and/or water conditioning polymers include, but are not limited to: those having pendant carboxylate (—$CO_2$-) groups such as polyacrylic acid, maleic acid, maleic/olefin copolymer, sulfonated copolymer or terpolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. These materials may also be used at sub stoichiometric levels to function as crystal modifiers.

Hardening Agents

Detergent compositions according to the present invention can also include a hardening agent in addition to, or in the form of, the builder. A hardening agent is a compound or system of compounds, organic or inorganic, which significantly contributes to the uniform solidification of the composition. Preferably, the hardening agents are compatible with the cleaning agent and other active ingredients of the composition and are capable of providing an effective amount of hardness and/or aqueous solubility to the processed composition. The hardening agents should also be capable of forming a homogeneous matrix with the cleaning agent and other ingredients when mixed and solidified to provide a uniform dissolution of the cleaning agent from the solid detergent composition during use.

The amount of hardening agent included in a solid detergent composition according to the present invention will vary according to factors including, but not limited to: the type of solid detergent composition being prepared, the ingredients of the solid detergent composition, the intended use of the composition, the quantity of dispensing solution applied to the solid composition over time during use, the temperature of the dispensing solution, the hardness of the dispensing solution, the physical size of the solid detergent composition, the concentration of the other ingredients, and the concentration of the cleaning agent in the composition. It is preferred that the amount of the hardening agent included in a solid detergent composition according to the present invention is effective to combine with the cleaning agent and other ingredients of the composition to form a homogeneous mixture under continuous mixing conditions and a temperature at or below the melting temperature of the hardening agent.

It is also preferred that the hardening agent form a matrix with the surfactant and/or other ingredients which will harden to a solid form under ambient temperatures of approximately 30° C. to approximately 50° C., particularly approximately 35° C. to approximately 45° C., after mixing ceases and the mixture is dispensed from the mixing system, within approximately a few seconds to a few hours, within approximately 1 minute to approximately 3 hours, particularly approximately 1 minute to approximately 2 hours, within approximately a few seconds to about a few minutes, and particularly approximately 5 minutes to approximately 1 hour. A minimal amount of heat from an external source may be applied to the mixture to facilitate processing of the mixture. It is preferred that the amount of the hardening agent included in the solid detergent composition is effective to provide a desired hardness and desired rate of controlled solubility of the processed composition when placed in an aqueous medium to achieve a desired rate of dispensing the cleaning agent from the solidified composition during use.

The hardening agent may be an organic or an inorganic hardening agent. A preferred organic hardening agent is a polyethylene glycol (PEG) compound. The solidification rate of solid detergent compositions comprising a polyethylene glycol hardening agent will vary, at least in part, according to the amount and the molecular weight of the polyethylene glycol added to the composition. Examples of suitable polyethylene glycols include, but are not limited to: solid polyethylene glycols of the general formula $H(OCH_2CH_2)_nOH$, where n is greater than 15, particularly approximately 30 to approximately 1700. Typically, the polyethylene glycol is a solid in the form of a free-flowing powder or flakes, having a molecular weight of approximately 1,000 to approximately 100,000, particularly having a molecular weight of at least approximately 1,450 to approximately 20,000, more particularly between approximately 1,450 to approximately 8,000. The polyethylene glycol is present at a concentration of from approximately 1% to 75% by weight and particularly approximately 3% to approximately 15% by weight. Suitable polyethylene glycol compounds include, but are not limited to: PEG 4000, PEG 1450, and PEG 8000 among others, with PEG 4000 and PEG 8000 being most preferred. An example of a commercially available solid polyethylene glycol includes, but is not limited to: CARBOWAX, available from Union Carbide Corporation, Houston, Tex.

Preferred inorganic hardening agents are hydratable inorganic salts, including, but not limited to: sulfates and bicarbonates. The inorganic hardening agents are present at concentrations of up to approximately 50% by weight, particularly approximately 5% to approximately 25% by weight, and more particularly approximately 5% to approximately 15% by weight.

Urea particles can also be employed as hardeners in the solid detergent compositions according to the present invention. The solidification rate of the compositions will vary, at least in part, to factors including, but not limited to: the amount, the particle size, and the shape of the urea added to the composition. For example, a particulate form of urea can be combined with a cleaning agent and other ingredients, and preferably a minor but effective amount of water. The amount and particle size of the urea is effective to combine with the cleaning agent and other ingredients to form a homogeneous mixture without the application of heat from an external source to melt the urea and other ingredients to a molten stage. It is preferred that the amount of urea included in the solid detergent composition is effective to provide a desired hardness and desired rate of solubility of the composition when placed in an aqueous medium to achieve a desired rate of dispensing the cleaning agent from the solidified composition during use. In some embodiments, the composition includes between approximately 5% to approximately 90% by weight urea, particularly between approximately 8% and approximately 40% by weight urea, and more particularly between approximately 10% and approximately 30% by weight urea.

Urea may be in the form of prilled beads or powder. Prilled urea is generally available from commercial sources as a mixture of particle sizes ranging from about 8-15 U.S. mesh, as for example, from Arcadian Sohio Company, Nitrogen Chemicals Division. A prilled form of urea is preferably milled to reduce the particle size to about 50 U.S. mesh to about 125 U.S. mesh, particularly about 75-100 U.S. mesh, preferably using a wet mill such as a single or twin-screw extruder, a Teledyne mixer, a Ross emulsifier, and the like.

Bleaching Agents

Bleaching agents suitable for use in solid detergent compositions according to the present invention for lightening or whitening a substrate include bleaching compounds capable of liberating an active halogen species, such as $Cl_2$, $Br_2$, —$OCl^-$ and/or —$OBr^-$, under conditions typically encountered during the cleansing process. Suitable bleaching agents for use in the solid detergent compositions include, but are not limited to: chlorine-containing compounds such as chlorines, hypochlorites, or chloramines. Exemplary halogen-releasing compounds include, but are not limited to: the alkali metal dichloroisocyanurates, chlorinated trisodium phosphate, the alkali metal hypochlorites, monochloramine, and dichloramine. Encapsulated chlorine sources may also be used to enhance the stability of the chlorine source in the composition (see, for example, U.S. Pat. Nos. 4,618,914 and 4,830,773, the disclosure of which is incorporated by reference herein in its entirety). A bleaching agent may also be a peroxygen or active oxygen source such as hydrogen peroxide, perborates, sodium carbonate peroxyhydrate, potassium permonosulfate, and sodium perborate mono and tetrahydrate, with and without activators such as tetraacetylethylene diamine. When the concentrate includes a bleaching agent, it can be included in an amount of between approximately 0.1% and approximately 60% by weight, between approximately 1% and approximately 20% by weight, between approximately 3% and approximately 8% by weight, and between approximately 3% and approximately 6% by weight. Without limiting the scope of the invention, the numeric ranges recited are understood to be inclusive of the numbers defining the range and include each integer within the defined range.

The solid detergent composition can include an effective amount of detergent fillers which do not perform as a cleaning agent per se, but cooperates with the cleaning agent to enhance the overall cleaning capacity of the composition. Examples of detergent fillers suitable for use in the present cleaning compositions include, but are not limited to: sodium sulfate and sodium chloride. When the concentrate includes a detergent filler, it can be included in an amount up to approximately 50% by weight, between approximately 1% and approximately 30% by weight, or between approximately 1.5% and approximately 25% by weight. Without limiting the scope of the invention, the numeric ranges recited are understood to be inclusive of the numbers defining the range and include each integer within the defined range.

Defoaming Agents

A defoaming agent for reducing the stability of foam may also be included in the solid detergent compositions according to the present invention. The term "defoamer" or "defoaming agent," as used herein, refers to a composition capable of reducing the stability of foam. Examples of defoaming agents include, but are not limited to: ethylene oxide/propylene block copolymers such as those available under the name Pluronic N-3; silicone compounds such as silica dispersed in polydimethylsiloxane, polydimethylsiloxane, and functionalized polydimethylsiloxane such as those available under the name Abil B9952; fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. Nos. 3,048,548, 3,334,147, and 3,442,242, the disclosures of which are incorporated herein by reference. When the concentrate includes a defoaming agent, the defoaming agent can be provided in an amount of between approximately 0.0001% and approximately 10% by weight, between approximately 0.001% and approximately 5% by weight, or between approximately 0.01% and approximately 1.0% by weight.

Anti-Redeposition Agents

Solid detergent compositions according to the present invention may include an anti-redeposition agent for facilitating sustained suspension of soils in a cleaning solution and preventing the removed soils from being redeposited onto the substrate being cleaned. Examples of suitable anti-redeposition agents include, but are not limited to: polyacrylates, styrene maleic anhydride copolymers, cellulosic derivatives such as hydroxyethyl cellulose, hydroxypropyl cellulose and carboxymethyl cellulose. When the concentrate includes an anti-redeposition agent, the anti-redeposition agent can be included in an amount of between approximately 0.5% and approximately 10% by weight, and between approximately 1% and approximately 5% by weight.

Stabilizing Agents

Solid detergent compositions according to the present invention may include stabilizing agents. Examples of suitable stabilizing agents include, but are not limited to: borate, calcium/magnesium ions, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include up to approximately 20% by weight, between approximately 0.5% and approximately 15% by weight, and between approximately 2% and approximately 10% by weight.

Dispersants

Solid detergent compositions according to the present invention may include one or more dispersants. Examples of suitable dispersants that can be used in the solid detergent composition include, but are not limited to: maleic acid/olefin copolymers, polyacrylic acid, and mixtures thereof. The concentrate need not include a dispersant, but when a dispersant is included it can be included in an amount that provides the desired dispersant properties. Exemplary ranges of the dispersant in the concentrate can be up to approximately 20% by weight, between approximately 0.5% and approximately 15% by weight, and between approximately 2% and approximately 9% by weight.

Enzymes

Enzymes that can be included in solid detergent compositions according to the present invention include those enzymes that aid in the removal of starch and/or protein stains. Exemplary types of enzymes include, but are not limited to: proteases, alpha-amylases, and mixtures thereof. Exemplary proteases that can be used include, but are not limited to: those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme, but when the concentrate includes an enzyme, it can be included in an amount that provides the desired enzymatic activity when the solid detergent composition is provided as a use composition. Exemplary ranges of the enzyme in the concentrate include up to approximately 15% by weight, between approximately 0.5% to approximately 10% by weight, and between approximately 1% to approximately 5% by weight. Without limiting the scope of the invention, the numeric ranges recited are understood to be inclusive of the numbers defining the range and include each integer within the defined range.

Glass and Metal Corrosion Inhibitors

Solid detergent compositions according to the present invention may include a metal corrosion inhibitor in an amount up to approximately 50% by weight, between approximately 1% and approximately 40% by weight, or between approximately 3% and approximately 30% by weight. Corrosion inhibitors included in solid detergent compositions according to the present invention is in an amount sufficient to provide a use solution that exhibits a rate of corrosion and/or etching of glass that is less than the rate of corrosion and/or etching of glass for an otherwise identical use solution except for the absence of the corrosion inhibitor. It is expected that the use solution will include at least approximately 6 parts per million (ppm) of the corrosion inhibitor to provide desired corrosion inhibition properties. It is expected that larger amounts of corrosion inhibitor can be used in the use solution without deleterious effects. It is expected that at a certain point, the additive effect of increased corrosion and/or etching resistance with increasing corrosion inhibitor concentration will be lost, and additional corrosion inhibitor will simply increase the cost of using the solid detergent composition. The use solution can include between approximately 6 ppm and approximately 300 ppm of the corrosion inhibitor, and between approximately 20 ppm and approximately 200 ppm of the corrosion inhibitor. Examples of suitable corrosion inhibitors include, but are not limited to: a combination of a source of aluminum ion and a source of zinc ion, as well as an alkaline metal silicate or hydrate thereof.

The term corrosion inhibitor can refer to the combination of a source of aluminum ion and a source of zinc ion. The source of aluminum ion and the source of zinc ion provide aluminum ion and zinc ion, respectively, when the solid detergent composition is provided in the form of a use solution. The amount of the corrosion inhibitor is calculated based upon the combined amount of the source of aluminum ion and the source of zinc ion. Anything that provides an aluminum ion in a use solution can be referred to as a source of aluminum ion, and anything that provides a zinc ion when provided in a use solution can be referred to as a source of zinc ion. It is not necessary for the source of aluminum ion and/or the source of zinc ion to react to form the aluminum ion and/or the zinc ion. Aluminum ions can be considered a source of aluminum ion, and zinc ions can be considered a source of zinc ion. The source of aluminum ion and the source of zinc ion can be provided as organic salts, inorganic salts, and mixtures thereof. Exemplary sources of aluminum ion include, but are not limited to: aluminum salts such as sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum zinc sulfate, and aluminum phosphate.

Exemplary sources of zinc ion include, but are not limited to: zinc salts such as zinc chloride, zinc sulfate, zinc nitrate, zinc iodide, zinc thiocyanate, zinc fluorosilicate, zinc dichromate, zinc chlorate, sodium zincate, zinc gluconate, zinc acetate, zinc benzoate, zinc citrate, zinc lactate, zinc formate, zinc bromate, zinc bromide, zinc fluoride, zinc fluorosilicate, and zinc salicylate.

An effective amount of an alkaline metal silicate or hydrate thereof can be employed in the solid detergent compositions according to the present invention to form a stable solid detergent composition having metal protecting capacity. Such silicates employed in the compositions of the invention are those that have conventionally been used in solid detergent formulations. For example, typical alkali metal silicates are those powdered, particulate or granular silicates which are either anhydrous or preferably which contain water of hydration (approximately 5% to approximately 25% by weight, particularly approximately 15% to approximately 20% by weight water of hydration). These silicates are preferably sodium silicates and have a $Na_2O$:$SiO_2$ ratio of approximately 1:1 to approximately 1:5, respectively, and typically contain available water in the amount of from approximately 5% to approximately 25% by weight. In general, the silicates have a $Na_2O$:$SiO_2$ ratio of approximately 1:1 to approximately 1:3.75, particularly approximately 1:1.5 to approximately 1:3.75 and most particularly approximately 1:1.5 to approximately 1:2.5. A silicate with a $Na_2O$:$SiO_2$ ratio of approximately 1:2 and approximately 16% to approximately 22% by weight water of hydration, is most preferred. For example, such silicates are available in powder form as GD Silicate and in granular form as Britesil H-20, available from PQ Corporation, Valley Forge, Pa. These ratios may be obtained with single silicate compositions or combinations of silicates which upon combination result in the preferred ratio. The hydrated silicates at preferred ratios, a $Na_2O$:$SiO_2$ ratio of approximately 1:1.5 to approximately 1:2.5, have been found to provide the optimum metal protection and rapidly form a solid detergent. Hydrated silicates are preferred.

Silicates can be included in solid detergent compositions according to the present invention to provide for metal protection but are additionally known to provide alkalinity and additionally function as anti-redeposition agents. Exemplary silicates include, but are not limited to: sodium silicate and potassium silicate. The solid detergent composition can be provided without silicates, but when silicates are included, they can be included in amounts that provide for desired metal protection. The concentrate can include silicates in amounts of at least approximately 1% by weight, at least approximately 5% by weight, at least approximately 10% by weight, and at least approximately 15% by weight. In addition, in order to provide sufficient room for other components in the concentrate, the silicate component can be provided at a level of less than approximately 35% by weight, less than approximately 25% by weight, less than approximately 20% by weight, and less than approximately 15% by weight.

Fragrances and Dyes

Various dyes, odorants including perfumes, and other aesthetic enhancing agents can also be included in the composition. Suitable dyes that may be included to alter the appearance of detergent compositions according to the present invention, include, but are not limited to: Direct Blue 86, available from Mac Dye-Chem Industries, Ahmedabad, India; Fastusol Blue, available from Mobay Chemical Corporation, Pittsburgh, Pa.; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keyston Analine and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Fragrances or perfumes that may be included in detergent compositions according to the present invention include, but are not limited to: terpenoids such as citronellol, aldehydes such as amyl cinnamaldehyde, a jasmine such as C1S-jasmine or jasmal, and vanillin.

Thickeners

Solid detergent compositions according to the present invention can include a rheology modifier or a thickener. The rheology modifier may provide the following functions: increasing the viscosity of the compositions; increasing the particle size of liquid use solutions when dispensed through a spray nozzle; providing the use solutions with vertical cling to surfaces; providing particle suspension within the use solutions; or reducing the evaporation rate of the use solutions.

A rheology modifier may provide a use composition that is pseudo plastic, in other words the use composition or material when left undisturbed (in a shear mode), retains a high viscosity. However, when sheared, the viscosity of the material is substantially but reversibly reduced. After the shear action is removed, the viscosity returns. These properties permit the application of the material through a spray head. When sprayed through a nozzle, the material undergoes shear as it is drawn up a feed tube into a spray head under the influence of pressure and is sheared by the action of a pump in a pump action sprayer. In either case, the viscosity can drop to a point such that substantial quantities of the material can be applied using the spray devices used to apply the material to a soiled surface. However, once the material comes to rest on a soiled surface, the materials can regain high viscosity to ensure that the material remains in place on the soil. Preferably, the material can be applied to a surface resulting in a substantial coating of the material that provides the cleaning components in sufficient concentration to result in lifting and removal of the hardened or baked-on soil. While in contact with the soil on vertical or inclined surfaces, the thickeners in conjunction with the other components of the cleaner minimize dripping, sagging, slumping or other movement of the material under the effects of gravity. The material should be formulated such that the viscosity of the material is adequate to maintain contact between substantial quantities of the film of the material with the soil for at least a minute, particularly five minutes or more.

Examples of suitable thickeners or rheology modifiers are polymeric thickeners including, but not limited to: polymers or natural polymers or gums derived from plant or animal sources. Such materials may be polysaccharides such as large polysaccharide molecules having substantial thickening capacity. Thickeners or rheology modifiers also include clays.

A substantially soluble polymeric thickener can be used to provide increased viscosity or increased conductivity to the use compositions. Examples of polymeric thickeners for the aqueous compositions of the invention include, but are not limited to: carboxylated vinyl polymers such as polyacrylic acids and sodium salts thereof, ethoxylated cellulose, polyacrylamide thickeners, cross-linked, xanthan compositions, sodium alginate and algin products, hydroxypropyl cellulose, hydroxyethyl cellulose, and other similar aqueous thickeners that have some substantial proportion of water solubility. Examples of suitable commercially available thickeners include, but are not limited to: Acusol, available from Rohm & Haas Company, Philadelphia, Pa.; and Carbopol, available from B.F. Goodrich, Charlotte, N.C.

Examples of suitable polymeric thickeners include, but not limited to: polysaccharides. An example of a suitable commercially available polysaccharide includes, but is not limited to, Diutan, available from Kelco Division of Merck, San Diego, Calif. Thickeners for use in the solid detergent compositions further include polyvinyl alcohol thickeners, such as, fully hydrolyzed (greater than 98.5 mol acetate replaced with the —OH function).

An example of a particularly suitable polysaccharide includes, but is not limited to, xanthans. Such xanthan polymers are preferred due to their high water solubility, and great thickening power. Xanthan is an extracellular polysaccharide of xanthomonas campestras. Xanthan may be made by fermentation based on corn sugar or other corn sweetener by-products. Xanthan comprises a poly beta-(1-4)-D-Glucopyranosyl backbone chain, similar to that found in cellulose. Aqueous dispersions of xanthan gum and its derivatives exhibit novel and remarkable rheological properties. Low concentrations of the gum have relatively high viscosities which permit it to be used economically. Xanthan gum solutions exhibit high pseudo plasticity, i.e. over a wide range of concentrations, rapid shear thinning occurs that is generally understood to be instantaneously reversible. Non-sheared materials have viscosities that appear to be independent of the pH and independent of temperature over wide ranges. Preferred xanthan materials include crosslinked xanthan materials. Xanthan polymers can be crosslinked with a variety of known covalent reacting crosslinking agents reactive with the hydroxyl functionality of large polysaccharide molecules and can also be crosslinked using divalent, trivalent or polyvalent metal ions. Such crosslinked xanthan gels are disclosed in U.S. Pat. No. 4,782,901, which is herein incorporated by reference. Suitable crosslinking agents for xanthan materials include, but are not limited to: metal cations such as Al+3, Fe+3, Sb+3, Zr+4 and other transition metals. Examples of suitable commercially available xanthans include, but are not limited to: KELTROL®, KELZAN® AR, KELZAN® D35, KELZAN® S, KELZAN® XZ, available from Kelco Division of Merck, San Diego, Calif. Known organic crosslinking agents can also be used. A preferred crosslinked xanthan is KELZAN® AR, which provides a pseudo plastic use solution that can produce large particle size mist or aerosol when sprayed.

Methods for Making a Solid Detergent Composition

Without being limited to a particular theory of the invention, the actual mechanism for solidification for detergent compositions according to the invention occurs through ash hydration. Additional methods of solidification matrix using polymers are described in U.S. Pat. No. 7,763,576, the disclosure of which is incorporated by reference herein its entirety.

The carboxylic acid terpolymer is combined with water prior to incorporation into the detergent composition and can be provided as a solid hydrate or as a solid salt that is solvated in an aqueous solution, e.g., in a liquid premix. However, the carboxylic acid terpolymer should be in a water matrix when added to the detergent composition for the detergent composition to effectively solidify. In general, an effective amount of carboxylic acid terpolymer is considered an amount that effectively controls the kinetics and thermodynamics of the solidification system by controlling the rate and movement of water.

The solid detergent composition according to the invention can be created by combining carboxylic acid terpolymer, sodium carbonate, water, and any additional functional components and allowing the components to interact and solidify. Those skilled in the art will appreciate suitable component concentration ranges for obtaining desired properties of the solidification matrix as disclosed herein.

In some embodiments, the relative amounts of water and carboxylic acid terpolymer are controlled within a composition. The solidification matrix and additional functional components harden into solid form due to the chemical reaction of the sodium carbonate with the water. As the solidification matrix solidifies, a binder composition can form to bind and solidify the components. At least a portion of the ingredients associate to form the binder while the balance of the ingredients forms the remainder of the solid composition. The solidification process may last from a few minutes to about six hours, depending on factors including, but not limited to: the size of the formed or cast composition, the ingredients of the composition, and the temperature of the composition.

According to embodiments of the invention, the solid detergent compositions according to the present invention is understood to mean a hardened composition that will not flow and will substantially retain its shape under moderate stress or pressure or mere gravity. The degree of hardness of the solid cast composition may range from that of a fused solid product which is relatively dense and hard, for example, like concrete, to a consistency characterized as being a hardened paste. In addition, the term "solid" refers to the state of the detergent composition under the expected conditions of storage and use of the solid detergent composition. In general, it is expected that the detergent composition will remain in solid form when exposed to temperatures of up to approximately 100° F. and preferably up to approximately 122° F.

Solid detergent compositions formed using the solidification matrix is produced using a batch or continuous mixing system. In an exemplary embodiment, a single- or twin-screw extruder is used to combine and mix one or more cleaning agents at high shear to form a homogeneous mixture. In some embodiments, the processing temperature is at or below the melting temperature of the components. The processed mixture may be dispensed from the mixer by forming, casting or other suitable means, whereupon the detergent composition hardens to a solid form. The structure of the matrix may be characterized according to its hardness, melting point, material distribution, crystal structure, and other like properties according to known methods in the art. Generally, a solid detergent composition processed according to the method of the invention is substantially homogeneous with regard to the distribution of ingredients throughout its mass and is dimensionally stable.

Specifically, in a forming process, the liquid and solid components are introduced into the final mixing system and are continuously mixed until the components form a substantially homogeneous semi-solid mixture in which the components are distributed throughout its mass. In an exemplary embodiment, the components are mixed in the mixing system for at least approximately 5 seconds. The mixture is then discharged from the mixing system into, or through, a die or other shaping means. The product is then packaged. In an exemplary embodiment, the formed composition begins to harden to a solid form in between approximately 1 minute and approximately 3 hours. Particularly, the formed composition begins to harden to a solid form in between approximately 1 minute and approximately 2 hours. More particularly, the formed composition begins to harden to a solid form in between approximately 1 minute and approximately 20 minutes.

Specifically, in a casting process, the liquid and solid components are introduced into the final mixing system and are continuously mixed until the components form a substantially homogeneous liquid mixture in which the components are distributed throughout its mass. In an exemplary embodiment, the components are mixed in the mixing system for at least approximately 60 seconds. Once the mixing is complete, the product is transferred to a packaging container where solidification takes place. In an exemplary embodiment, the cast composition begins to harden to a solid form in between approximately 1 minute and approximately 3 hours. Particularly, the cast composition begins to harden to a solid form in between approximately 1 minute and approximately 2 hours. More particularly, the cast composition begins to harden to a solid form in between approximately 1 minute and approximately 20 minutes.

Methods of Use of the Solid Detergent Compositions

The embodiments of the present invention are particularly useful in cleaning applications. Beneficially, the use of the carboxylic acid terpolymer according to the invention provide dimensional stability further provide cleaning efficacy. For example, the methods of cleaning employing the carboxylic acid terpolymer provide additional benefits of anti-redeposition of soils on substrate surfaces and reduced scale accumulation and/or scale inhibition.

According to the embodiments of the invention the solid detergent compositions can be utilized for any pressed, extruded and/or cast solid detergent compositions. Still further, according to the invention the composition can be utilized for any molded or formed solid pellet, block, tablet, powder, granule, flake or the formed solid can thereafter be ground or formed into a powder, granule, or flake.

In addition, according to the invention the solid detergent compositions can further be utilized for any solid compositions containing a hydratable salt and water, including but not limited to uses related to: machine and manual ware-washing, presoaks, laundry and textile cleaning and destaining, carpet cleaning and destaining, vehicle cleaning and care applications, surface cleaning and destaining, kitchen and bath cleaning and destaining, floor cleaning and destaining, cleaning in place operations, general purpose cleaning and destaining, industrial or household cleaners, and pest control agents.

The compositions of the invention are further suitable for use in various applications and methods, including any application suitable for an alkali metal hydroxide and/or alkali metal carbonate detergent wherein the prevention of hard water scale accumulation on surfaces is desired. In addition, the methods of the invention are well suited for controlling water hardness buildup on a plurality of surfaces. The methods of the invention prevent moderate to heavy accumulation of hardness and/or the redeposition of soils on treated substrate surfaces which beneficially improving the aesthetic appearance of the surface. In certain embodiments, surfaces in need of hard water scale accumulation prevention, include for example, plastics, metal and/or glass surfaces.

In a beneficial aspect of the invention, the methods of the invention reduce the formation, precipitation and/or deposition of hard water scale, such as calcium carbonate, on hard surfaces contacted by the detergent compositions. In an embodiment, the detergent compositions are employed for the prevention of formation, precipitation and/or deposition of hard water scale on articles such as glasses, plates, silverware, etc. The solid detergent compositions according to the invention beneficially provide such prevention of formation, precipitation and/or deposition of hard water scale despite the high alkalinity of the detergent composition use solutions in the presence of hard water.

The employed solid detergent composition may take forms including, but not limited to: a cast solid product; an extruded, molded or formed solid pellet, block, tablet, powder, granule, flake; or the formed solid can thereafter be ground or formed into a powder, granule, or flake. In an exemplary embodiment, extruded pellet materials formed by the solidification matrix have a weight of between approximately 50 grams and approximately 250 grams, extruded solids formed by the solidification matrix have a weight of approximately 100 grams or greater, and solid block detergents formed by the solidification matrix have a mass of between approximately 1 and approximately 10 kilograms. The solid compositions provide for a stabilized source of functional materials. In some embodiments, the solid composition may be dissolved, for example, in an aqueous or other medium, to create a concentrated and/or use solution. The solution may be directed to a storage reservoir for later use and/or dilution, or may be applied directly to a point of use.

In certain embodiments, the solid detergent composition is provided in the form of a unit dose. A unit dose refers to a solid detergent composition unit sized so that the entire unit is used during a single washing cycle. When the solid detergent composition is provided as a unit dose, it is typically provided as a cast solid, an extruded pellet, or a tablet having a size of between approximately 1 gram and approximately 50 grams.

In other embodiments, the solid detergent composition is provided in the form of a multiple-use solid, such as a block or a plurality of pellets, and can be repeatedly used to generate aqueous detergent compositions for multiple washing cycles. In certain embodiments, the solid detergent composition is provided as a cast solid, an extruded block, or a tablet having a mass of between approximately 5 grams and approximately 10 kilograms. In certain embodiments, a multiple-use form of the solid detergent composition has a mass between approximately 1 kilogram and approximately 10 kilograms. In further embodiments, a multiple-use form of the solid detergent composition has a mass of between approximately 5 kilograms and about approximately 8 kilograms. In other embodiments, a multiple-use form of the solid detergent composition has a mass of between about approximately 5 grams and approximately 1 kilogram, or between approximately 5 grams and approximately 500 grams.

Although the detergent composition is discussed as being formed into a solid product, the detergent composition may also be provided in the form of a paste. When the concentrate is provided in the form of a paste, enough water is added to the detergent composition such that complete solidification of the detergent composition is precluded. In addition, dispersants and other components may be incorporated into the detergent composition in order to maintain a desired distribution of components.

Methods of use employing the solid detergent compositions according to the invention are particularly suitable for institutional ware washing. Exemplary disclosure of ware-washing applications is set forth in U.S. Pat. Nos. 8,758,520 and 9,139,800 and U.S. Patent Pub. No. 2002/0291808, including all references cited therein, which are herein incorporated by reference in its entirety. The method may be carried out in any consumer or institutional dish machine, including for example those described in U.S. Pat. No. 8,092,613, which is incorporated herein by reference in its entirety, including all figures and drawings. Some non-limiting examples of dish machines include door machines or hood machines, conveyor machines, undercounter machines, glasswashers, flight machines, pot and pan machines, utensil washers, and consumer dish machines. The dish machines may be either single tank or multi-tank machines.

A door dish machine, also called a hood dish machine, refers to a commercial dish machine wherein the soiled dishes are placed on a rack and the rack is then moved into the dish machine. Door dish machines clean one or two racks at a time. In such machines, the rack is stationary and the wash and rinse arms move. A door machine includes two sets arms, a set of wash arms and a rinse arm, or a set of rinse arms.

Door machines may be a high temperature or low temperature machine. In a high temperature machine the dishes are sanitized by hot water. In a low temperature machine the dishes are sanitized by the chemical sanitizer. The door machine may either be a recirculation machine or a dump and fill machine. In a recirculation machine, the detergent solution is reused, or "recirculated" between wash cycles. The concentration of the detergent solution is adjusted between wash cycles so that an adequate concentration is maintained. In a dump and fill machine, the wash solution is not reused between wash cycles. New detergent solution is added before the next wash cycle. Some non-limiting examples of door machines include the Ecolab Omega HT, the Hobart AM-14, the Ecolab ES-2000, the Hobart LT-1, the CMA EVA-200, American Dish Service L-3DW and HT-25, the Autochlor A5, the Champion D-HB, and the Jackson Tempstar.

The detergent compositions are effective at preventing hard water scale accumulation and/or preventing the redeposition of soils in warewashing applications using a variety of water sources, including hard water. In addition, the detergent compositions are suitable for use at temperature ranges typically used in industrial warewashing applications, including for example from about 150° F. to about 165° F. during washing steps and from about 170° F. to about 185° F. during rinsing steps.

In addition, the methods of use of the detergent compositions are also suitable for CIP and/or COP processes to replace the use of bulk detergents leaving hard water residues on treated surfaces. The methods of use may be desirable in additional applications where industrial standards are focused on the quality of the treated surface, such that the prevention of hard water scale accumulation provided by the detergent compositions of the invention are desirable. Such applications may include, but are not limited to, vehicle care, industrial, hospital and textile care.

Additional examples of applications of use for the detergent compositions include, for example, alkaline detergents effective as grill and oven cleaners, ware wash detergents, laundry detergents, laundry presoaks, drain cleaners, hard surface cleaners, surgical instrument cleaners, transportation vehicle cleaning, vehicle cleaners, dish wash presoaks, dish wash detergents, beverage machine cleaners, concrete cleaners, building exterior cleaners, metal cleaners, floor finish strippers, degreasers and burned-on soil removers. In a variety of these applications, cleaning compositions having a very high alkalinity are most desirable and efficacious, however the damage caused by hard water scale accumulation is undesirable.

The various methods of use according to the invention employ the use of the detergent composition, which may be formed prior to or at the point of use by combining the PSO derivatives, alkalinity source and other desired components (e.g. optional polymers and/or surfactants) in the weight percentages disclosed herein. The detergent composition may be provided in various formulations. The methods of the invention may employ any of the formulations disclosed, including for example, liquids, semi-solids and/or other solid formulations.

The methods of the invention may also employ a concentrate and/or a use solution constituting an aqueous solution or dispersion of a concentrate. Such use solutions may be formed during the washing process such as during warewashing processes.

In aspects of the invention employing packaged solid detergent compositions, the products may first require removal from any applicable packaging (e.g. film). Thereafter, according to certain methods of use, the compositions can be inserted directly into a dispensing apparatus and/or provided to a water source for cleaning according to the invention. Examples of such dispensing systems include for example U.S. Pat. Nos. 4,826,661, 4,690,305, 4,687,121, 4,426,362 and U.S. Pat. Nos. Re 32,763 and 32,818, the disclosures of which are incorporated by reference herein in its entirety. Ideally, a solid detergent composition is configured or produced to closely fit the particular shape(s) of a dispensing system in order to prevent the introduction and dispensing of an incorrect solid product into the apparatus of the present invention.

In certain embodiments, the detergent composition may be mixed with a water source prior to or at the point of use. In other embodiments, the detergent compositions do not require the formation of a use solution and/or further dilution and may be used without further dilution.

In aspects of the invention employing solid detergent compositions, a water source contacts the detergent composition to convert solid detergent compositions, particularly powders, into use solutions. Additional dispensing systems may also be utilized which are more suited for converting alternative solid detergents compositions into use solutions. The methods of the present invention include use of a variety of solid detergent compositions, including, for example, extruded blocks or "capsule" types of package.

In an aspect, a dispenser may be employed to spray water (e.g. in a spray pattern from a nozzle) to form a detergent use solution. For example, water may be sprayed toward an apparatus or other holding reservoir with the detergent composition, wherein the water reacts with the solid detergent composition to form the use solution. In certain embodiments of the methods of the invention, a use solution may be configured to drip downwardly due to gravity until the dissolved solution of the detergent composition is dispensed for use according to the invention. In an aspect, the use solution may be dispensed into a wash solution of a ware wash machine.

All publications and patent applications in this specification are indicative of the level of ordinary skill in the art to which this invention pertains. All publications and patent applications are herein incorporated by reference to the same extent as if each individual publication or patent application was specifically and individually indicated as incorporated by reference.

EXAMPLES

Embodiments of the present invention are further defined in the following non-limiting Examples. It should be understood that these Examples, while indicating certain embodiments of the invention, are given by way of illustration only. From the above discussion and these Examples, one skilled in the art can ascertain the essential characteristics of this invention, and without departing from the spirit and scope thereof, can make various changes and modifications of the embodiments of the invention to adapt it to various usages and conditions. Thus, various modifications of the embodiments of the invention, in addition to those shown and described herein, will be apparent to those skilled in the art from the foregoing description. Such modifications are also intended to fall within the scope of the appended claims.

The materials used in the following Examples are provided herein:

Dequest 2010®: 60% solution of 1-hydroxyethylidene-1,1,-diphosphonic acid, HEDP (also referred to as 1-hydroxy-1,1-ethylidene diphosphonate).

Dehypon® LS-36: low foaming fatty alcohol alkoxylate, EO/PO derivative (CASR-No. 68439-51-0), commercially available from BASF Corporation.

Pluronic® 25-R-2: difunctional block copolymer surfactant with terminal secondary hydroxyl groups.

Terpolymer (A.): 75:20:5 wt-% of polymerized monomers a1:a2:a3, see table below (molecular weight $M_w$5500 g/mol (determined by gel permeation chromatography (GPC)); K-value 19.5, determined in 1 wt % aqueous solution).

Terpolymer (A.2): 75:20:5 wt-% of polymerized monomers a1:a2:a3, see table below (molecular weight $M_w$ 6500 g/mol (determined by GPC); K-value 23.2, determined in 1 wt % aqueous solution).

Terpolymer (a.3): 60:10:30 wt-% of polymerized monomers a1:a2:a3, see table below (K-value 20.7, determined in 1 wt % aqueous solution).

Terpolymer (a.4): 40:30:30 wt-% of polymerized monomers a1:a2:a3 (K-value 20.8 determined in 1 wt % aqueous solution).

The molecular weights of terpolymers (A. 1) to (A.4) were measured by GPC in buffered aqueous solutions (pH value: 7) and/or provided as defined in the K-value of the respective terpolymer (A).

Composition of terpolymers (A.1) to (A.4):

| terpolymer | monomer a1 | monomer a2 | monomer a3 |
|---|---|---|---|
| (A.1) | acrylic acid | AMPS | $H_2C{=}CH{-}CH_2{-}O[EO]_{17}{-}H$ |
| (A.2) | acrylic acid | AMPS | $H_2C{=}CH{-}CH_2{-}O[EO]_{17}{-}H$ |
| (A.3) | acrylic acid | AMPS | $H_2C{=}CH{-}CH_2{-}O[EO]_{17}{-}H$ |
| (A.4) | acrylic acid | AMPS | $H_2C{=}CH{-}CH_2{-}O[EO]_{17}{-}H$ |

Example 1

Solid compositions of a stability-enhanced detergent containing carboxylic acid terpolymer were compared to controls (without the carboxylic acid terpolymer) as shown below in Table 1. The experimental formulas according to the invention were calculated to have the same ash to water ratio as the Control formulas at the time of the experiment. The reference to ppm (parts per million) for the binding agent refer to the amounts in the use concentration calculated using 1000 ppm of detergent composition.

TABLE 1

| Pressed Solid Compositions | | | | | |
|---|---|---|---|---|---|
| Description | Control | 1 | 2 | 3 | 4 |
| Dense Ash (sodium carbonate) | 82.3 | 82.3 | 82.3 | 82.3 | 82.3 |
| Water (Soft) | 3.02 | | | | |
| Dequest 2010 (60%) | 1 | 1 | 1 | 1 | 1 |
| KOH (45%) | 8.89 | 7.6 | 6 | 6.7 | 6.35 |
| Dehypon LS-36 | 3.68 | 3.68 | 3.68 | 3.68 | 3.68 |
| Pluronic 25-R-2 | 1.11 | 1.11 | 1.11 | 1.11 | 1.11 |
| Terpolymer (A.1) (44%) | | 6.82 | | | |
| Terpolymer (A.2) (39%) | | | 7.69 | | |
| Terpolymer (A.3) (41%) | | | | 7.32 | |
| Terpolymer (A.4) (40%) | | | | | 7.5 |
| Total | 100 | 102.51 | 101.78 | 102.11 | 101.94 |
| Water content | 8.3984 | 8.3992 | 8.3909 | 8.4038 | 8.3925 |
| Ash:Water | 9.8 | 9.8 | 9.81 | 9.79 | 9.81 |

Water and the terpolymers (A. 1) to (A.4), respectively were mixed together thoroughly. In a separate container the dense ash (i.e. hydratable ashes) was mixed together thoroughly. The liquid premix was gradually added to the dry components while stirring until homogeneous (about 5 minutes). 50 grams of detergent so obtained was immediately poured into a circular pressing die and pressed at 1000 psi for 20 seconds. Tablets of solid detergent compositions were obtained and stored at room temperature for 1 hour after the tablets had been pressed, then the initial height and diameter were measured. These values were used as the initial height and diameter for the stability experiments described below.

The calculation of the water content and the ash: water ratio include measurement of the total water in the solid detergent compositions. Water can be added to the composition (such as the Control) and/or water can refer to the water associated with the terpolymer (A).

Tablets were placed in an oven at 100° F. and or 122° F. Experiments were performed with two tablets for each temperature (4 total tablets for each composition). Additional measurements were recorded after 1 and 2 weeks. The average percent growth measured at 1 week and 2 weeks for each tablet as shown in Tables 2 and 3, respectively. Less than 3% growth (preferably less than 2% growth) in either height or diameter under the most stringent conditions (122° F.) indicated effective control of the carboxylic acid terpolymer on the dimensional stability of the composition.

TABLE 2

| Detergent Composition | Temp (F.) | Average % Growth 1 week Diameter | Height | Average |
|---|---|---|---|---|
| Control | 100° | 12.35 | 9.43 | 10.89 |
| 1 | 100° | 0.74 | −0.27 | 0.24 |
| 2 | 100° | 1.39 | 0.7 | 1.05 |
| C-3 | 100° | 2.47 | 0.49 | 1.48 |
| C-4 | 100° | 18.22 | 15.91 | 17.07 |
| Control | 122° | 41.65 | 28.81 | 35.23 |
| 1 | 122° | 0.34 | −0.44 | −0.05 |
| 2 | 122° | 0.89 | 0.33 | 0.61 |
| C-3 | 122° | 2.43 | 1.85 | 2.14 |
| C-4 | 122° | Melted | Melted | — |

TABLE 3

| Detergent Composition | Temp (F.) | Average % Growth 2 weeks Diameter | Height | Average |
|---|---|---|---|---|
| Control | 100° | 14.88 | 10.87 | 12.88 |
| 1 | 100° | 0.56 | 0.27 | 0.42 |
| 2 | 100° | 1.41 | 1.19 | 1.30 |
| C-3 | 100° | Melted | Melted | — |
| C-4 | 100° | 24.35 | 20.3 | 22.33 |
| Control | 122° | 48.84 | 36.43 | 42.64 |
| 1 | 122° | 1.21 | 0.49 | 0.85 |
| 2 | 122° | 1.79 | 1.1 | 1.45 |
| C-3 | 122° | 4.74 | 4.99 | 4.87 |
| C-4 | 122° | Melted | Melted | — |

The inventions being thus described, it will be obvious that the same may be varied in many ways. Such variations are not to be regarded as a departure from the spirit and scope of the inventions and all such modifications are intended to be included within the scope of the following claims.

What is claimed is:

1. A solid detergent composition comprising:

between about 0.1 wt-% and about 20 wt-% of a terpolymer (A), said terpolymer (A) comprising in copolymerized form from about 75% by weight of acrylic acid, of about 20% by weight of 2-acrylamido-2-methylpropanesulfonic acid, and of about 5% by weight of a nonionic monomer of the formula (I)

$$H_2C{=}CH{-}CH_2{=}O[EO]_{17}{-}H \quad (I)$$

in which EO is ethylene oxide units;

between about 0.1 wt-% and about 50 wt-% water;

between about 65 wt-% and about 95 wt-% alkali metal carbonate; and between about 0.5 wt-% and about 10 wt-% at least two surfactants, wherein the at least two surfactants are a fatty alcohol alkoxylate, and an EO/PO copolymer having terminal hydroxyl groups;

wherein the solid detergent composition is dimensionally stable and has a growth exponent of less than 3% if heated at a temperature of 122° F.

2. The composition of claim 1, wherein the terpolymer (A) further comprises in copolymerized form up to about 30% by weight of one or more further ethylenically unsaturated monomers.

3. The composition of claim 1, further comprising at least one functional ingredient selected from the group consisting of: additional surfactants, chelating agents, sequestering agents, inorganic detergents, organic detergents, alkaline sources, builders, water conditioners, rinse aids, hardening agents, bleaching agents, sanitizers, activators, fillers, defoaming agents, anti-redeposition agents, optical brighteners, dyes, odorants, stabilizing agents, dispersants, enzymes, corrosion inhibitors, thickeners and solubility modifiers.

4. A method of forming a solid detergent composition comprising:

combining between about 65 wt-% and about 95 wt-% of an alkali metal carbonate, water, a terpolymer (A), said terpolymer (A) comprising in copolymerized form from about 75% by weight of acrylic acid, of about 20% by weight of 2-acrylamido-2-methylpropanesulfonic acid, and of about 5% by weight of a nonionic monomer of the formula (I)

$$H_2C{=}CH{-}CH_2{=}O[EO]_{17}{-}H \quad (I)$$

in which EO is ethylene oxide units, and at least two surfactants, wherein the at least two surfactants are a fatty alcohol alkoxylate, and an EO/PO copolymer having terminal hydroxyl groups; and forming a cast, pressed, or extruded solid;

wherein the solid detergent composition is dimensionally stable and has a growth exponent of less than 3% if heated at a temperature of 122° F.

5. The method of claim 4, wherein the solid detergent composition further comprises least one functional ingredient selected from the group consisting of: additional surfactants, chelating agents, sequestering agents, inorganic detergents, organic detergents, alkaline sources, builders, water conditioners, rinse aids, hardening agents, bleaching agents, sanitizers, activators, fillers, defoaming agents, anti-redeposition agents, optical brighteners, dyes, odorants, stabilizing agents, dispersants, enzymes, corrosion inhibitors, thickeners and solubility modifiers.

6. A method of forming a solid detergent composition that is dimensionally stable and has a growth exponent of less than 3% when heated at a temperature of 122° F., comprising the steps of:

combining an alkali metal carbonate, at least two surfactants, wherein the at least two surfactants are a fatty alcohol alkoxylate, and an EO/PO copolymer having terminal hydroxyl groups; and at least one functional component to form a powder pre-mix; and mixing the powder pre-mix with a liquid pre-mix, the liquid pre-mix comprising water and a terpolymer (A), said terpolymer (A) comprising in copolymerized form from about 75% by weight of acrylic acid, of about 20% by weight of 2-acrylamido-2-methylpropanesulfonic acid, and of about 5% by weight of a nonionic monomer of the formula (I)

$$H_2C{=}CH{-}CH_2{=}O[EO]_{17}{-}H \quad (I)$$

in which EO is ethylene oxide units, wherein the solid detergent composition comprises between 65 wt-% and about 95 wt-% of the alkali metal carbonate.

7. The method of claim 6, further including the step of casting, pressing, and/or extruding the mixture obtained from mixing the powder pre-mix with a liquid pre-mix.

8. The method of claim 6, wherein the functional component is selected from the group consisting of: surfactants, chelating agents, sequestering agents, inorganic detergents, organic detergents, alkaline sources, builders, water conditioners, rinse aids, hardening agents, bleaching agents, sanitizers, activators, fillers, defoaming agents, anti-redeposition agents, optical brighteners, dyes, odorants, stabilizing agents, dispersants, enzymes, corrosion inhibitors, thickeners and solubility modifiers.

* * * * *